US005942383A

United States Patent [19]

Hioki et al.

[11] Patent Number: 5,942,383

[45] Date of Patent: Aug. 24, 1999

[54] SILVER HALIDE PHOTOGRAPHIC LIGHT-SENSITIVE MATERIAL

[75] Inventors: Takanori Hioki; Mikio Ihama; Tetsuya Watanabe, all of Minami-ashigara, Japan

[73] Assignee: Fuji Photo Film Co., Ltd., Kanagawa-ken, Japan

[21] Appl. No.: 08/790,248

[22] Filed: Jan. 28, 1997

[30] Foreign Application Priority Data

Jan. 30, 1996 [JP] Japan ..... 8-034235

[51] Int. Cl.[6] ..... G03C 1/12; G03C 1/34

[52] U.S. Cl. ..... 430/584; 430/581; 430/583; 430/585; 430/592; 430/603; 430/611

[58] Field of Search ..... 430/584, 581, 430/582, 583–595, 604, 611, 496, 603, 605

[56] References Cited

U.S. PATENT DOCUMENTS 4,960,689 10/1990 Nishikawa et al. ..... 430/605
5,432,050 7/1995 James et al. ..... 430/496

FOREIGN PATENT DOCUMENTS 1077611 8/1967 United Kingdom .

*Primary Examiner*—Thorl Chea
*Attorney, Agent, or Firm*—Sughrue, Mion, Zinn Macpeak & Seas, PLLC

[57] ABSTRACT

There is disclosed a silver halide photographic light-sensitive material having at least one silver halide emulsion layer on a support, wherein the silver halide grains in at least one of the emulsion layers are subjected to reduction sensitization, and at least one of the emulsion layers contains at least one compound represented by general formula (I):

General formula (I)

wherein R represents a sulfonylalkenyl group; $L_1$ and $L_2$ each represent a methine group; $p_1$ is 0 or 1; $Z_1$ represents a group of atoms required to form a 5- or 6-membered nitrogen-containing heterocycle; $M_1$ represents a counter ion for balance of a charge; $m_1$ is a number of from 0 to 10 required to neutralize a charge of the molecule; and Q represents a methine or polymethine group substituted with a heterocyclic or aromatic group. The material has high sensitivity, low fog, and excellent storage stability.

11 Claims, No Drawings

SILVER HALIDE PHOTOGRAPHIC LIGHT-SENSITIVE MATERIAL

FIELD OF THE INVENTION

The present invention relates to a silver halide photographic light-sensitive material. More particularly, the present invention relates to a silver halide photographic light-sensitive material that has high sensitivity with low fog, and that has excellent storage stability.

BACKGROUND OF THE INVENTION

From the past, considerable efforts have been made for high-speed silver halide photographic light-sensitive materials. It is known that a sensitizing dye for use in spectral sensitization has a great effect on the properties of a silver halide photographic light-sensitive material. Even a slight difference in structure of sensitizing dyes sometimes greatly affects photographic properties, such as sensitivity, fog, and storage stability. However, it is difficult to estimate photographic effects from sensitizing dyes' structures in advance. Therefore, many researchers have been making an effort to synthesize many sensitizing dyes and to investigate their photographic properties. Often used sensitizing dyes are those composed of a nitrogen-containing heterocycle having a sulfoalkyl group, as a partial structure. With respect to a sulfoalkyl group, a 2-sulfoethyl group, a 3-sulfopropyl group, a 4-sulfobutyl group, and a 3-sulfobutyl group are well known. However, the present state of the art is that other sulfoalkyl groups besides these groups have scarcely been investigated, so that it is impossible to estimate photographic properties that are shown by various kinds of other sulfoalkyl groups.

Further, in order to increase the sensitivity of a photographic light-sensitive material, reduction sensitization has long been investigated. For example, tin compounds in U.S. Pat. No. 2,487,850, polyamine compounds in U.S. Pat. No. 2,512,925, and thiourea dioxide-series compounds in British Patent No. 789,823, respectively, have been disclosed as useful reduction sensitizers. Further, in *Photographic Science and Engineering*, Vol. 23, page 113 (1979), properties of silver nuclei, which had been manufactured by various kinds of reduction sensitization methods, were investigated, and as a result it was found that methods for using dimethylamine borane, stannous chloride, or hydrazine, and methods for ripening at a high pH, or at a low pAg, are useful for reduction sensitization. Reduction sensitization methods are also disclosed in U.S. Pat. Nos. 2,518,698, 3,201,254, 3,411,917, 3,779,777, and 3,930,867. JP-B ("JP-B" means examined Japanese patent publication) Nos. 33572/1982 and 1410/1983 each describe not only selection of a reduction sensitizer but also how to perform reduction sensitization.

However, the present inventor's investigation found that, when spectral sensitization was conducted by adsorbing a sensitizing dye onto a reduction-sensitized silver halide grain, and particularly when spectral sensitization was performed in the spectral regions of green and red, it was extremely difficult to attain sufficient spectral sensitivity without causing some photographically adverse effects (e.g. an increase of fog).

Further, use is well known of a method in which a sensitizing dye is adsorbed onto a silver halide grain at a high temperature (not lower than 50° C.), so that the sensitizing dye on the silver halide grain is prevented from desorption in a light-sensitive material (especially in an atmosphere of high humidity), or a method in which a sensitizing dye is adsorbed onto a silver halide grain before chemical sensitization, in order to increase sensitivity. However, it was found that when such methods were applied to a reduction-sensitized photographic emulsion, in which a spectral sensitizing dye, especially for a green and red spectral region, had been adsorbed on a silver halide grain, fog extremely increased.

Therefore, there is need for development of a technology by which reduction-sensitized silver halide grains are spectrally sensitized to attain high sensitivity without causing any adverse effects, such as fog formation.

SUMMARY OF THE INVENTION

An object of the present invention is to provide a silver halide photographic light-sensitive material that has high sensitivity with low fog, and that has excellent storage stability.

Other and further objects, features, and advantages of the invention will appear more fully from the following description.

DETAILED DESCRIPTION OF THE INVENTION

As a result of intensive investigation, the above-described object of the present invention has been attained by a silver halide photographic light-sensitive material having at least one silver halide emulsion layer on a support, wherein the silver halide grains in at least one of the emulsion layers are subjected to reduction sensitization, and at least one of the emulsion layers contains at least one compound represented by the following general formula (I):

General formula (I)

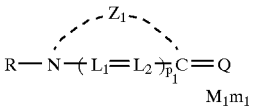

wherein R represents a sulfoalkenyl group; $L_1$ and $L_2$ each represent a methine group; $p_1$ represents 0 or 1; $Z_1$ represents a group of atoms required to form a 5- or 6-membered nitrogen-containing heterocycle; $M_1$ represents a counter ion for balance of a charge; $m_1$ represents a number of from 0 to 10 required to neutralize a charge of the molecule; and Q represents a methine group or a polymethine group, each of which is substituted with a heterocyclic group or an aromatic group.

Further preferably, the compounds represented by general formula (I) are selected from those represented by the following general formula (II):

General formula (II)

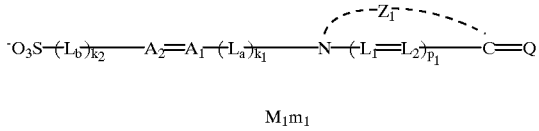

wherein $L_a$ and $L_b$ each represent a methylene group; $A_1$ and $A_2$ each represent a methine group; $k_1$ and $k_2$ each represent an integer of from 0 to 10; and $L_1$, $L_2$, $p_1$, $Z_1$, $M_1$, $m_1$, and Q each have the same meanings as those defined in general formula (I).

Further, more preferably the compounds represented by general formula (II) are selected from those represented by the following general formula (III), (IV), or (V):

General formula (III)

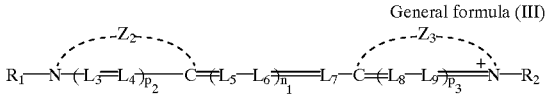

$M_2m_2$ wherein $L_3$, $L_4$, $L_5$, $L_6$, $L_7$, $L_8$, and $L_9$ each represent a methine group; p2 and p3 each represent 0 or 1; $n_1$ represents 0, 1, 2, or 3; $Z_2$ and $Z_3$ each represent a group of atoms required to form a 5- or 6-membered nitrogen-containing heterocycle; $M_2$ represents a counter ion for balance of a charge; $m_2$ represents a number of from 0 to 4 required to neutralize a charge of the molecule; and $R_1$ and $R_2$ each represent an alkyl group, with the proviso that at least one of $R_1$ and $R_2$ is an alkyl group represented by the following $R_z$:

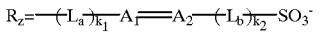

wherein $L_a$, $L_b$, $A_1$, $A_2$, $k_1$, and $k_2$ each have the same meanings as those defined in general formula (II).

General formula (IV)

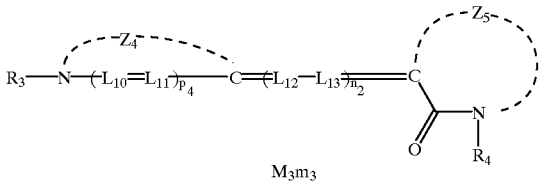

$M_3m_3$ wherein $L_{10}$, $L_{11}$, $L_{12}$, and $L_{13}$ each represent a methine group; $p_4$ represents 0 or 1; $n_2$ represents 0, 1, 2, or 3; $Z_4$ and $Z_5$ each represent a group of atoms required to form a 5- or 6-membered nitrogen-containing heterocycle; $M_3$ represents a counter ion for balance of a charge; $m_3$ represents a number of from 0 to 4 required to neutralize a charge of the molecule; $R_3$ represents an alkyl group, and $R_4$ represents an alkyl group, an aryl group, or a heterocyclic group, with the proviso that $R_3$ is an alkyl group represented by the above-described $R_z$.

6-membered nitrogen-containing heterocycle; $M_4$ represents a counter ion for balance of a charge; $m_4$ represents a number of from 0 to 4 required to neutralize a charge of the molecule; $R_5$ and $R_7$ each represent an alkyl group, and $R_6$ represents an alkyl group, an aryl group, or a heterocyclic group, with the proviso that at least one of $R_5$ and $R_7$ is an alkyl group represented by the above-described $R_z$.

Compounds for use in the present invention are explained in detail below.

Because of Q, kinds of methine dyes that can be formed are not limited in particular, but preferable examples thereof include a cyanine dye, a merocyanine dye, a rhodacyanine, a tri-nuclei merocyanine dye, a halopolar dye, a hemicyanine dye, and a styryl dye. Details of these dyes are described by, for example, F. M. Harmer in *Heterocyclic Compounds-Cyanine Dyes and Related Compounds*, John Wiley & Sons Co., in New York and London (1964), and by D. M. Sturmer in *Heterocyclic Compounds—Special Topics in Heterocyclic Chemistry*, Chapter 18, Section 14, pp. 482 to 515.

Preferable general formulae of the cyanine dye, the merocyanine dye, and the rhodacyanine dye, respectively, are those shown by general formulae (XI), (XII), and (XIII) on pages 21 and 22 of U.S. Pat. No. 5,340,694.

Further, when a cyanine dye is formed by Q in general formula (I), such a dye may be illustrated by the following resonance formula:

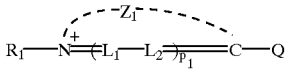

$M_1m_1$

Examples of the 5- or 6-membered nitrogen-containing heterocycle represented by $Z_1$, $Z_2$, $Z_3$, $Z_4$, $Z_6$ and $Z_8$ in general formulae (I), (II), (III), (IV), and (V) include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g. 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, and a pyrimidine nucleus.

General formula (V)

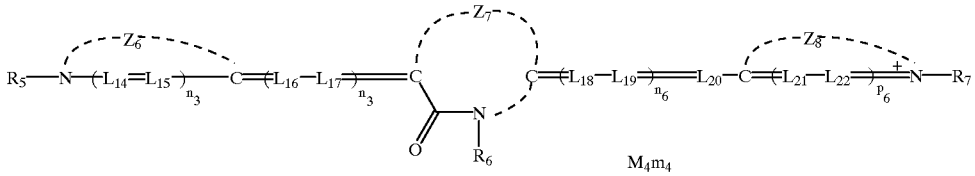

$M_4m_4$ wherein $L_{14}$, $L_{15}$, $L_{16}$, $L_{17}$, $L_{18}$, $L_{19}$, $L_{20}$, $L_{21}$, and $L_{22}$ each represent a methine group; $p_5$ and $p_6$ each represent 0 or 1; $n_3$ and $n_4$ each represent 0, 1, 2, or 3; $Z_6$, $Z_7$, and $Z_8$ each represent a group of atoms required to form a 5- or Preferred of these nuclei are a benzoxazole nucleus, a benzothiazole nucleus, a benzimidazole nucleus, and a quinoline nucleus. A benzoxazole nucleus and a benzothiazole nucleus are more preferred. Particularly preferably, each of the nuclei completed by $Z_2$ and $Z_3$ in general formula (III) is a benzoxazole nucleus.

$Z_1$, $Z_2$, $Z_3$, $Z_4$, $Z_6$, and $Z_8$ may have a substituent (hereinafter referred to as V). The substituent represented by V is not limited in particular, but examples thereof include a halogen atom (e.g. chlorine, bromine, iodine, and fluorine), a mercapto group, a cyano group, a carboxyl group, a phosphoric acid group, a sulfo group, a hydroxyl group; a carbamoyl group having 1 to 10 carbon atoms, preferably 2 to 8 carbon atoms, and more preferably 2 to 5 carbon atoms (e.g. methylcarbamoyl, ethylcarbamoyl, morpholinocarbamoyl); a sulfamoyl group having 0 to 10 carbon atoms, preferably 2 to 8 carbon atoms, and more preferably 2 to 5 carbon atoms (e.g. methylsulfamoyl, ethylsulfamoyl, and piperidinosulfonyl); a nitro group; an alkoxy group having 1 to 20 carbon atoms, preferably 1 to 10 carbon atoms, and more preferably 1 to 8 carbon atoms (e.g. methoxy, ethoxy, 2-methoxyethoxy, and 2-phenylethoxy); an aryloxy group having 6 to 20 carbon atoms, preferably 6 to 12 carbon atoms, and more preferably 6 to 10 carbon atoms (e.g. phenoxy, p-methylphenoxy, p-chlorophenoxy, and naphthoxy); an acyl group having 1 to 20 carbon atoms, preferably 2 to 12 carbon atoms, and more preferably 2 to 8 carbon atoms (e.g. acetyl, benzoyl, and trichloroacetyl); an acyloxy group having 1 to 20 carbon atoms, preferably 2 to 12 carbon atoms, and more preferably 2 to 8 carbon atoms (e.g. acetyloxy and benzoyloxy); an acylamino group having 1 to 20 carbon atoms, preferably 2 to 12 carbon atoms, and more preferably 2 to 8 carbon atoms (e.g. acetylamino); a sulfonyl group having 1 to 20 carbon atoms, preferably 1 to 10 carbon atoms, and more preferably 1 to 8 carbon atoms (e.g. methanesulfonyl, ethanesulfonyl, and benzenesulfonyl); a sulfinyl group having 1 to 20 carbon atoms, preferably 1 to 10 carbon atoms, and more preferably 1 to 8 carbon atoms (e.g. methanesulfinyl and benzenesulfinyl); a sulfonylamino group having 1 to 20 carbon atoms, preferably 1 to 10 carbon atoms, and more preferably 1 to 8 carbon atoms (e.g. methanesulfonylamino, ethanesulfonylamino, and benzenesulfonylamino); an amino group; a substituted amino group having 1 to 20 carbon atoms, preferably 1 to 12 carbon atoms, and more preferably 1 to 8 carbon atoms (e.g. methylamino, dimethylamino, benzylamino, anilino, and diphenylamino); an ammonium group having 0 to 15 carbon atoms, preferably 3 to 10 carbon atoms, and more preferably 3 to 6 carbon atoms (e.g. trimethylammonium and triethylammonium); a hydrazino group having 0 to 15 carbon atoms, preferably 1 to 10 carbon atoms, and more preferably 1 to 6 carbon atoms (e.g. trimethylhydrazino); a ureido group having 1 to 15 carbon atoms, preferably 1 to 10 carbon atoms, and more preferably 1 to 6 carbon atoms (e.g. ureido and N,N-dimethylureido); an imido group having 1 to 15 carbon atoms, preferably 1 to 10 carbon atoms, and more preferably 1 to 6 carbon atoms (e.g. succinimido); an alkyl or aryl thio group having 1 to 20 carbon atoms, preferably 1 to 12 carbon atoms, and more preferably 1 to 8 carbon atoms (e.g. methylthio, ethylthio, carboxyethylthio, sulfobutylthio, and phenylthio); an alkoxycarbonyl group having 2 to 20 carbon atoms, preferably 2 to 12 carbon atoms, and more preferably 2 to 8 carbon atoms (e.g. methoxycarbonyl, ethoxycarbonyl, and benzyloxycarbonyl); an aryloxycarbonyl group having 6 to 20 carbon atoms, preferably 6 to 12 carbon atoms, and more preferably 6 to 8 carbon atoms (e.g. phenoxycarbonyl); an unsubstituted alkyl group having 1 to 18 carbon atoms, preferably 1 to 10 carbon atoms, and more preferably 1 to 5 carbon atoms (e.g. methyl, ethyl, propyl, and butyl); a substituted alkyl group having 1 to 18 carbon atoms, preferably 1 to 10 carbon atoms, and more preferably 1 to 5 carbon atoms [e.g. hydroxymethyl, trifluoromethyl, benzyl, carboxyethyl, ethoxycarbonylmethyl, and acetylaminomethyl; the substituted alkyl group herein referred to may be an unsaturated hydrocarbon group having 2 to 18 carbon atoms, preferably 3 to 10 carbon atoms, and more preferably 3 to 5 carbon atoms (e.g. vinyl, ethynyl, 1-cyclohexenyl, benzylidyne, and benzylidene)]; a substituted or unsubstituted aryl group having 6 to 20 carbon atoms, preferably 6 to 15 carbon atoms, and more preferably 6 to 10 carbon atoms (e.g. phenyl, naphthyl, p-carboxyphenyl, p-nitrophenyl, 3,5-dichlorophenyl, p-cyanophenyl, m-fluorophenyl, and p-tolyl); and a substituted or unsubstituted heterocyclic group having 1 to 20 carbon atoms, preferably 2 to 10 carbon atoms, and more preferably 4 to 6 carbon atoms (e.g. pyridyl, 5-methylpyridyl, thienyl, furyl, morpholino, and tetrahydrofurfuryl). Further, a benzene ring or a naphthalene ring may be condensed with the heterocycle that is completed by $Z_1$, $Z_2$, $Z_3$, $Z_4$, $Z_6$, or $Z_8$.

Further, these substituents may be additionally substituted with V.

Preferred of the substituents on $Z_1$, $Z_2$, $Z_3$, $Z_4$, $Z_6$, or $Z_8$, are an alkyl group, an aryl group, an alkoxy group, a halogen atom, an acyl group, a cyano group, a sulfonyl group, and condensation of a benzene ring, as described above. More preferably the substituents are an alkyl group, an aryl group, a halogen atom, an acyl group, a sulfonyl group, and condensation of a benzene ring. Further preferably they are a methyl group, a phenyl group, a methoxy group, a chlorine atom, a bromine atom, an iodine atom, and condensation of a benzene ring. Most preferably they are a phenyl group, a chlorine atom, a bromine atom, and an iodine atom.

R in general formula (I) represents a sulfoalkenyl group; that is, R has at least one double bond.

Typically, R can be represented by $R_{za}$ shown below.

$$R_{za}=-(L_{aa})_{k_{1a}}-(A_{1a}=A_{2a})_{k_{4a}}-(L_{ca})_{k_{3a}}-(A_{3a}=A_{4a})_{k_{5a}}-(L_{ba})_{k_{2a}}SO_3^-$$

wherein $L_{aa}$, $L_{ba}$, and $L_{ca}$ each have the same meanings as those defined by $L_a$ and $L_b$; $A_{1a}$, $A_{2a}$, $A_{3a}$, and $A_{4a}$ each have the same meanings as $A_1$ and $A_2$; and $K_{1a}$, $K_{2a}$, $K_{3a}$, $K_{4a}$, and $K_{5a}$ each represent an integer of from 0 to 10.

$L_a$ and $L_b$ in general formula (II) and $R_z$ each represent an unsubstituted methylene group, or a substituted methylene group (e.g. a methylene group substituted with the above-described V. Specific examples of the substituted methylene group include methylene groups, that are substituted with a methyl group, an ethyl group, a phenyl group, a hydroxyl group, or a halogen atom (e.g. chlorine and bromine)). An unsubstituted methylene group is preferred.

$A_1$ and $A_2$ each represent an unsubstituted methine group, or a substituted methine group (e.g. a methine group substituted with the above-described V. Specific examples of the substituted methine group include methine groups that are substituted with a methyl group, an ethyl group, a phenyl group, a hydroxyl group, or a halogen atom (e.g. chlorine and bromine)). Preferred of these methine groups are those that are unsubstituted, or those that are substituted with a methyl group, a chlorine atom, or a bromine atom.

$k_1$ and $k_2$ each represent an integer of from 0 to 10. $k_1$ is preferably 1, 2, 3, or 4, more preferably 1 or 2, and particularly preferably 1. $k_2$ is preferably 0, 1, 2, 3, or 4, more preferably 0 or 1, and particularly preferably 0. When $k_1$ or $k_2$ is 2 or more, methylene groups are repeated, and they may be the same or different.

Specific examples of a sulfoalkenyl group in general formulae (I), (II), (III), (IV), and (V) are illustrated below. Preferred examples are shown in the order of from $R_{a1}$ to $R_{a9}$. Consequently, $R_{a9}$ indicates the most preferable example.

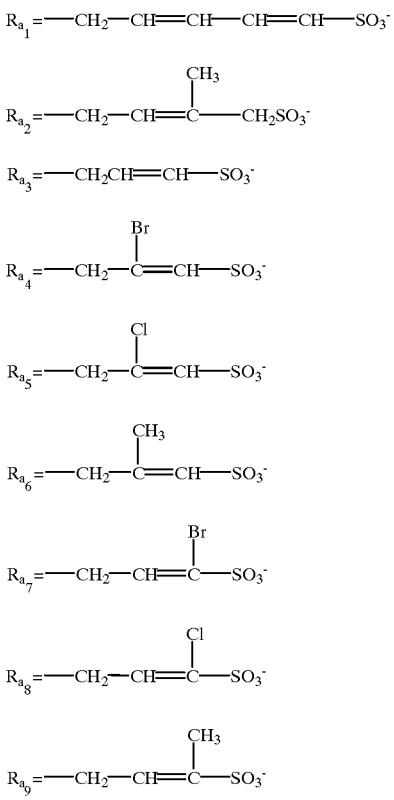

Herein, the sulfo moiety of a sulfoalkenyl group for use in the present invention is illustrated by the form of dissociation (i.e. $—SO_3^-$), but as a matter of course, it can form the state of non-dissociation (i.e. $—SO_3H$). Among specific examples for use in the present invention, the state of non-dissociation is illustrated, for convenience, by $—SO_3^-H^+$, which is a combination of $—SO_3^-$ and a hydrogen ion ($H^+$) as a counter ion for balance of a charge.

$R_1$, $R_2$, $R_3$, $R_5$, and $R_7$ in general formulae (III), (IV), and (V) each represent an alkyl group. Examples of the alkyl group represented by $R_1$, $R_2$, $R_3$, $R_5$, or $R_7$ include an unsubstituted alkyl group having 1 to 18 carbon atoms, preferably 1 to 7 carbon atoms, and particularly preferably 1 to 4 carbon atoms (e.g. methyl, ethyl, propyl, isopropyl, butyl, isobutyl, hexyl, octyl, dodecyl, and octadecyl); a substituted alkyl group having 1 to 18 carbon atoms, preferably 1 to 7 carbon atoms, and particularly preferably 1 to 4 carbon atoms {For example, is mentioned an alkyl group substituted with V, which is mentioned as a substituent for the above-described $Z_1$, etc. Preferable examples of the substituted alkyl group include an aralkyl group (e.g. benzyl and 2-phenylethyl), an unsaturated hydrocarbon group (e.g. allyl), a hydroxyalkyl group (e.g. 2-hydroxyethyl and 3-hydroxypropyl), a carboxyalkyl group (e.g. 2-carboxyethyl, 3-carboxypropyl, 4-carboxybutyl, and carboxymethyl), an alkoxyalkyl group (e.g. 2-methoxyethyl and 2-(2-methoxyethoxy)ethyl), an aryloxyalkyl group (e.g. 2-phenoxyethyl and 2-(1-naphthoxy)ethyl), an alkoxycarbonylalkyl group (e.g. ethoxycarbonylmethyl and 2-benzyloxycarbonylethyl), an aryloxycarbonylalkyl group (e.g. 3-phenoxycarbonylpropyl), an acyloxyalkyl group (e.g. 2-acetyloxyethyl), an acylalkyl group (e.g. 2-acetylethyl), a carbamoylalkyl group (e.g. 2-morpholinocarbonylethyl), a sulfamoylalkyl group (e.g. N,N-dimethylcarbamoylmethyl), a sulfoalkyl group (e.g. 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl), a sulfoalkenyl group (e.g. groups represented by $R_1$ or $R_z$ according to the present invention), a sulfatoalkyl group (e.g. 2-sulfatoethyl, 3-sulfatopropyl, and 4-sulfatobutyl), a heterocycle substituted alkyl group (e.g. 2-(pyrrolidine-2-one-1-yl)ethyl and tetrahydrofurfuryl), and an alkylsulfonylcarbamoylmethyl group (e.g. methanesulfonylcarbamoylmethyl)}.

Preferred of the alkyl groups represented by $R_1$, $R_2$, $R_3$, $R_5$, and $R_7$, are a carboxyalkyl group, a sulfoalkyl group, and a sulfoalkenyl group according to the present invention, as described above, with a sulfoalkyl group and a group represented by $R_z$ according to the present invention more preferred.

$Z_5$ represents a group of atoms required to form an acidic nucleus, which may be any form of the acidic nucleus for a general merocyanine dye. The term "acidic nucleus" herein referred to has the same meaning as defined by, for example, T. H. James in *The Theory of the Photographic Process*, 4th Edition, Macmillan Co. (1977), page 198. Specific examples of the acidic nucleus include those described in, for example, U.S. Pat. Nos. 3,567,719, 3,575,869, 3,804,634, 3,837,862, 4,002,480, and 4,925,777, and JP-A ("JP-A" means unexamined published Japanese patent application) No. 167546/1991.

Preferably, the acidic nucleus forms a 5- or 6-membered nitrogen-containing heterocycle that is composed of atoms selected from a carbon atom, a nitrogen atom, and a chalcogen atom (typically, oxygen, sulfur, selenium, and tellurium). Specific examples of the acidic nucleus include 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazoline-2,4-dione, isooxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide.

Acidic nuclei completed by $Z_5$ are preferably hydantoin, 2- or 4-thiohydantoin, 2-oxazoline-5-one, 2-thiooxazoline-2,4-dione, thiazolidine-2,4-dione, rhodanine, thiazolidine-2,4-dithione, barbitric acid, and 2-thiobarbitric acid, more preferably hydantoin, 2- or 4-thiohydantoin, 2-oxazoline-5-one, rhodanine, barbitric acid, and 2-thiobarbitric acid, and particularly preferably 2- or 4-thiohydantoin, 2-oxazoline-5-one, and rhodanine.

Examples of the 5- or 6-membered nitrogen-containing heterocycle formed by $Z_7$ are the same as those mentioned with respect to $Z_5$, with the proviso that an oxo group or a thioxo group is removed from the heterocycle formed by $Z_5$. Preferably the heterocycles are hydantoin, 2- or 4-thiohydantoin, 2-oxazoline-5-one, 2-thiooxazoline-2,4-dione, thiazolidine-2,4-dione, rhodanine, thiazolidine-2,4-dithione, barbitric acid, and 2-thiobarbitric acid, from each of which an oxo group or a thioxo group is removed. Further preferably the heterocycles are hydantoin, 2- or 4-thiohydantoin, 2-oxazoline-5-one, rhodanine, barbitric acid, and 2-thiobarbitric acid, from each of which an oxo group or a thioxo group is removed. 2- or 4-thiohydantoin, 2-oxazoline-5-one, and rhodanine, from each of which an oxo group or a thioxo group is removed, are particularly preferred.

Examples of the alkyl group represented by $R_4$ and $R_6$ include unsubstituted alkyl groups and substituted alkyl groups, as mentioned with respect to $R_1$, etc. Preferable examples thereof are the same as those mentioned for $R_1$, etc. Further, examples of the aryl group and the heterocyclic group, each of which is respectively represented by $R_4$ and $R_6$, include an unsubstituted aryl group having 6 to 20 carbon atoms, preferably 6 to 10 carbon atoms, and more preferably 6 to 8 carbon atoms (e.g. phenyl and 1-naphthyl); a substituted aryl group having 6 to 20 carbon atoms, preferably 6 to 10 carbon atoms, and more preferably 6 to 8 carbon atoms (for example, an aryl group substituted with V, which is used as a substituent for the above-described $Z_1$, etc.; specific examples include a p-methoxyphenyl group, a p-methylphenyl group, and a p-chlorophenyl group); an unsubstituted heterocyclic group having 1 to 20 carbon atoms, preferably 3 to 10 carbon atoms, and more preferably 4 to 8 carbon atoms (e.g. 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), and 5-tetrazolyl); and a substituted heterocyclic group having 1 to 20 carbon atoms, preferably 3 to 10 carbon atoms, and more preferably 4 to 8 carbon atoms (for example, a heterocyclic group substituted with V, which is used as a substituent for the above-described $Z_1$, etc.; specific examples include a 5-methyl-2-thienyl group and a 4-methoxy-2-pyridyl group).

Preferable specific examples of $R_4$ and $R_6$ each include a methyl group, an ethyl group, a 2-sulfoethyl group, a 3-sulfopropyl group, a 3-sulfobutyl group, a 4-sulfobutyl group, a carboxymethyl group, a phenyl group, a 2-pyridyl group, and a 2-thiazolyl group, with an ethyl group, a 2-sulfoethyl group, a carboxymethyl group, a phenyl group, and a 2-pyridyl group more preferred.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, and $L_{22}$ each independently represent a methine group. The methine group represented by each of $L_1$ to $L_{22}$ may have a substituent. Examples of the substituent include a substituted or unsubstituted alkyl group having 1 to 15 carbon atoms, preferably 1 to 10 carbon atoms, and more preferably 1 to 5 carbon atoms (e.g. methyl, ethyl, and 2-carboxyethyl); a substituted or unsubstituted aryl group having 6 to 20 carbon atoms, preferably 6 to 15 carbon atoms, and more preferably 6 to 10 carbon atoms (e.g. phenyl and o-carboxyphenyl); a substituted or unsubstituted heterocyclic group having 3 to 20 carbon atoms, preferably 4 to 15 carbon atoms, and more preferably 6 to 10 carbon atoms (e.g. a N,N-diethylbarbitric acid group); a halogen atom (e.g. chlorine, bromine, fluorine, and iodine); an alkoxy group having 1 to 15 carbon atoms, preferably 1 to 10 carbon atoms, and more preferably 1 to 5 carbon atoms (e.g. methoxy and ethoxy); an alkylthio group having 1 to 15 carbon atoms, preferably 1 to 10 carbon atoms, and more preferably 1 to 5 carbon atoms (e.g. methylthio and ethylthio); an arylthio group having 6 to 20 carbon atoms, preferably 6 to 15 carbon atoms, and more preferably 6 to 10 carbon atoms (e.g. phenylthio); and an amino group having 0 to 15 carbon atoms, preferably 2 to 10 carbon atoms, and more preferably 4 to 10 carbon atoms (e.g. N,N-diphenylamino, N-methyl-N-phenylamino, and N-methylpiperadino). Further, the substituent may be bonded to another methine group to form a ring. Alternatively, the substituent may be bonded to an auxochrome to form a ring.

Each of $n_1$, $n_2$, and $n_3$ is preferably 0 or 1, and more preferably 1. $n_4$ is preferably 0 or 1, and more preferably 0. When $n_1$, $n_2$, $n_3$, or $n_4$ is 2 or more, methine groups are repeated, and they may be the same or different.

$M_1$, $M_2$, $M_3$, and $M_4$ each are illustrated in general formula, in order to demonstrate the presence of a cation or an anion, when they are necessary to neutralize an ionic charge of a dye. Typical examples of the cation include inorganic cations, such as a hydrogen ion ($H^+$), alkali metal ions (e.g. a sodium ion, a potassium ion, and a lithium ion), and alkali earth metal ions (e.g. a calcium ion); and organic cations, such as ammonium ions (e.g. an ammonium ion, a tetraalkyl ammonium ion, a pyridinium ion, and an ethylpyridinium ion). The anion may be an inorganic anion or an organic anion, and examples of the anion include halogen anions (e.g. a fluorine ion, a chlorine ion, and an iodine ion), substituted arylsulfonate ions (e.g. a p-toluenesulfonate ion and a p-chlorobenzenesulfonate ion), aryldisulfonate ions (e.g. a 1,3-benzenesulfonate ion, a 1,5-naphthalenedisulfonate ion, and a 2,6-naphthalenedisulfonate ion), alkylsulfate ions (e.g. a methylsulfate ion), a sulfate ion, a thiocyanate ion, a perchlorate ion, a tetrafluoroborate ion, a picrate ion, an acetate ion, and a trifluoromethanesulfonate ion. Further, ionic polymers or other dyes having an opposite charge to that of the dye, may also be used as a counter ion.

$m_1$, $m_2$, $m_3$, and $m_4$ each represent a number necessary to balance a charge, and when an intermolecular salt is formed, the number is 0.

$p_1$, $p_2$, $p_3$, $p_4$, $p_5$, and $p_6$ each independently represent 0 or 1, and preferably 0.

General formula (III) is most preferred of general formulae (III), (IV), and (V).

Specific examples of the compounds represented by general formula (I), (II), (III), (IV), or (V) for use in the present invention are illustrated below, but the present invention is not limited to them. Since the conception of general formula (II) is narrower than that of general formula (I), and in turn, each of the conceptions of general formulae (III), (IV), and (V) is narrower than that of general formula (II), other compounds besides the specific examples of general formulae (II), (III), (IV), and (V) are shown as specific examples of general formulae (I) and (II).

Specific examples of the compounds represented by general formula (III)

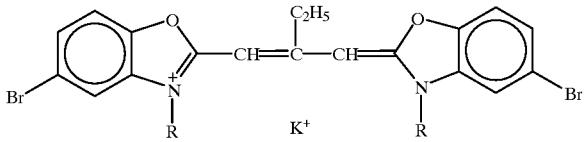
(III-1)
R = $—CH_2CH═CH—SO_3^-$
(III-2)
R = $—CH_2C(Cl)═CH—SO_3^-$
(III-3)
R = $—CH_2C(CH_3)═CH—SO_3^-$
(III-4)
R = $—CH_2CH═C(Br)—SO_3^-$
(III-5)
R = $—CH_2CH═C(CH_3)—SO_3^-$
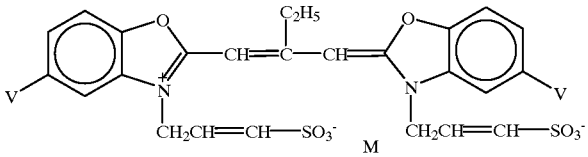
(III-6)
V = 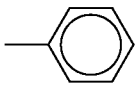 M = $K^+$
(III-7)
V = Cl M = $K^+$
(III-8)
V = I M = $K^+$
(III-9)
V = $—C(=O)CH_3$ M = $Na^+$
(III-10)
V = 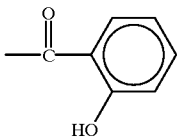 M = $K^+$
(III-11)
V = 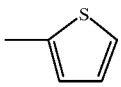 M = $Na^+$ -continued
(III-11A)
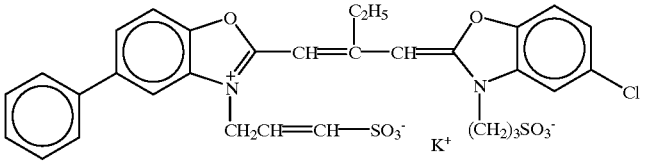
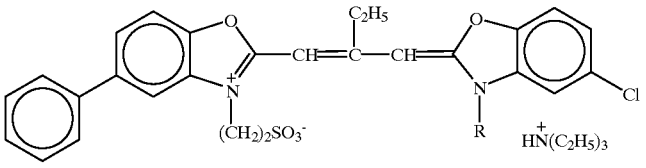
(III-12)
R = $—CH_2CH═CH—SO_3^-$
(III-13)
R = $—CH_2CH═C(CH_3)—SO_3^-$
(III-14)
R = $—CH_2CH═CH—CH_2—SO_3^-$
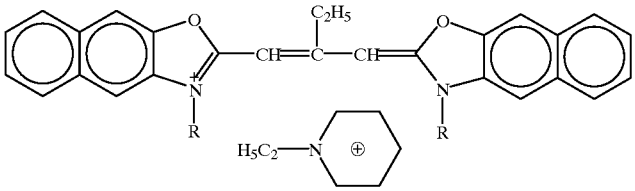
(III-15)
R = $—CH_2CH═CH—SO_3^-$
(III-16)
R = $—CH_2CH═C(CH_3)—SO_3^-$
(III-17)
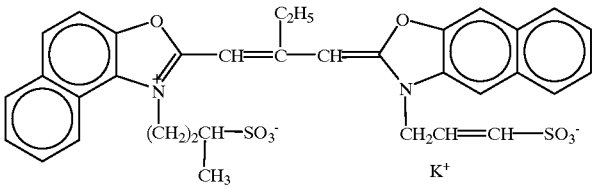
(III-18)
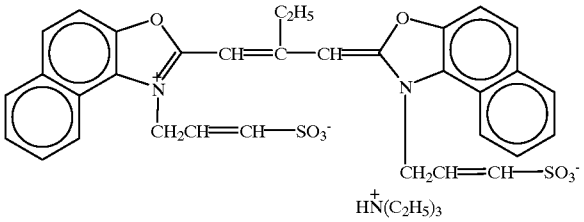

-continued
(III-19)
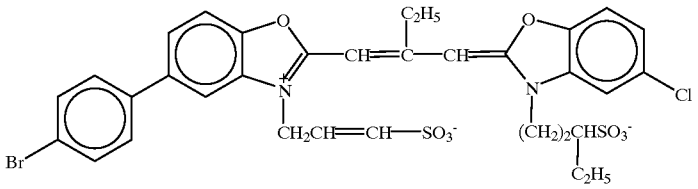
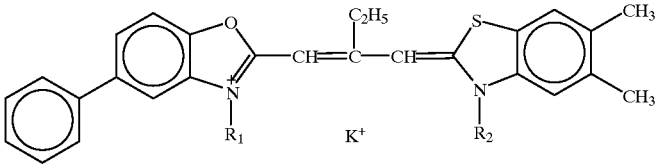
(III-20)
$R_1$ = —$CH_2CH{=}CH$—$SO_3^-$,
$R_2$ = —$(CH_2)_4$—$SO_3^-$
(III-21)
$R_1$ = —$(CH_2)_2$—$SO_3^-$,
$R_2$ = —$CH_2CH{=}CH$—$SO_3^-$
(III-22)
$R_1$ = —$(CH_2)_2$—$SO_3^-$,
$R_2$ = —$CH_2CH{=}C(CH_3)$—$SO_3^-$
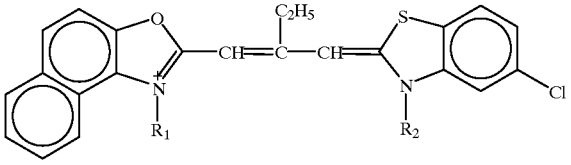
(III-23)
$R_1$ = —$CH_2CH{=}CH$—$SO_3^-$,
$R_2$ = —$(CH_2)_4$—$SO_3^-$
(III-24)
$R_1$ = —$(CH_2)_2CH(CH_3)$—$SO_3^-$,
$R_2$ = —$CH_2CH{=}CH$—$SO_3^-$
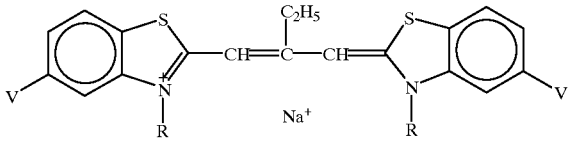
(III-25)
V = Cl, R = —$CH_2CH{=}CH$—$SO_3^-$
(III-26)
V = Br, R = —$CH_2CH{=}C(CH_3)$—$SO_3^-$ -continued
(III-27)
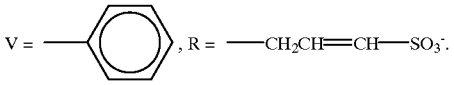
(III-28)
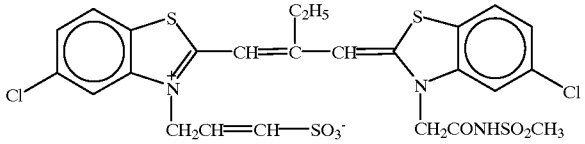
(III-29)
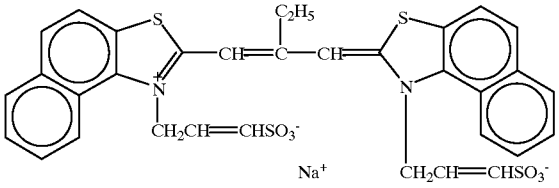
(III-30)
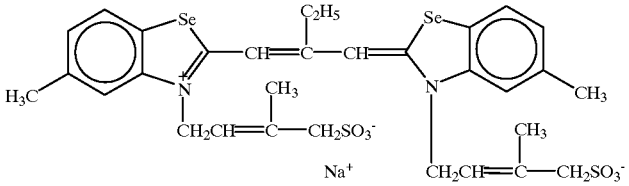
(III-31)
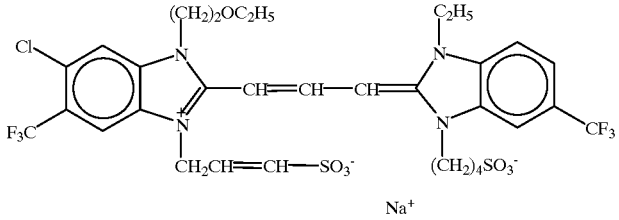
(III-32)
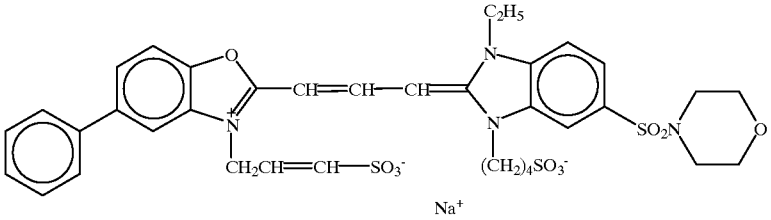
(III-33)
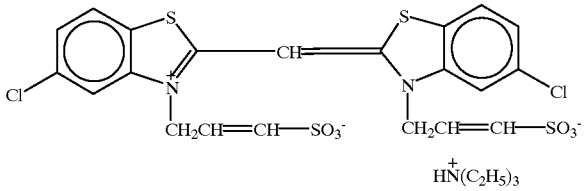

-continued
(III-34)
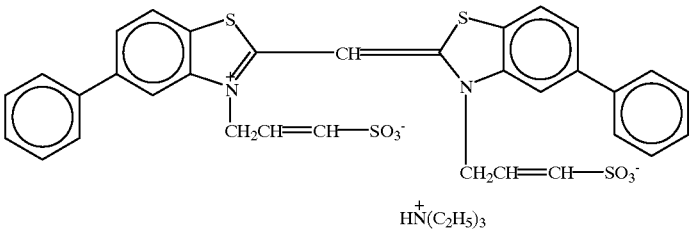
(III-39)
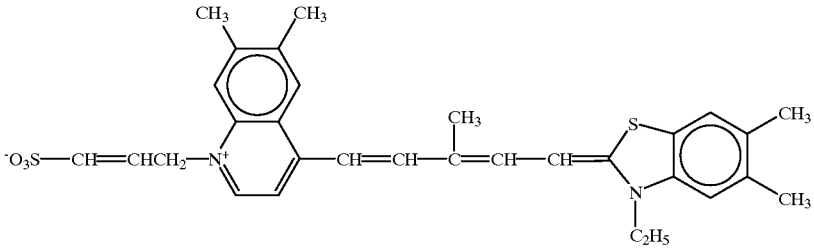
(III-40)
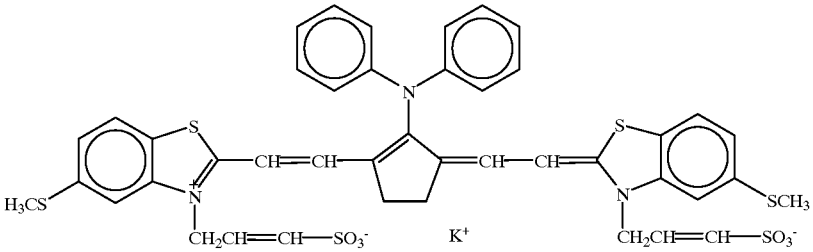
Specific examples of the compounds represented by general formula (IV)
(IV-1)
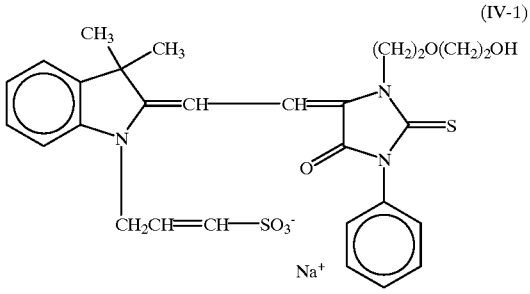
(IV-2)
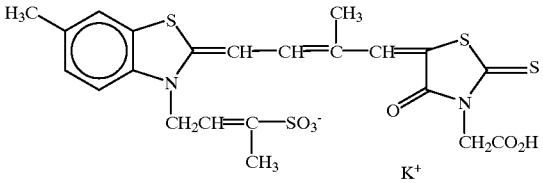
-continued
(IV-3)
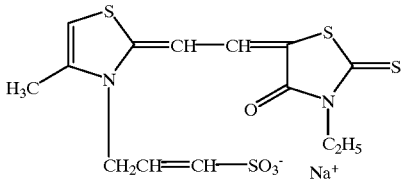
(IV-4)
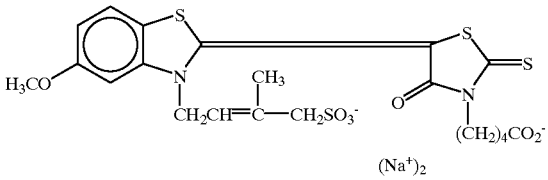
(IV-5)
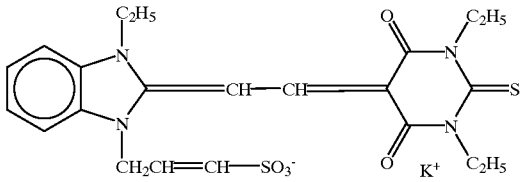

-continued
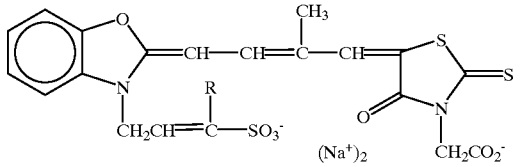
(IV-6)
R = $CH_3$
(IV-7)
R = $C_2H_5$
(IV-8)
R = 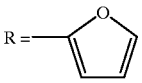
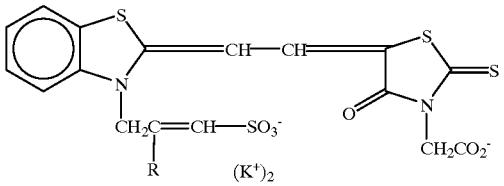
(IV-9)
R = $CH_3$
-continued
(IV-10)
R = Br
(IV-11)
R = —Cl
(IV-12)
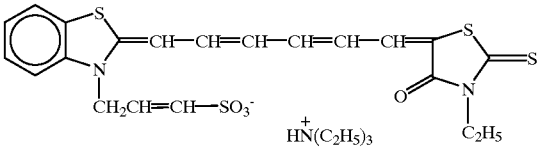
(IV-13)
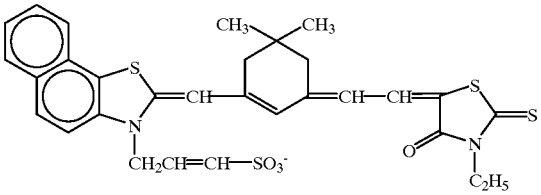
Specific examples of the compounds represented by general formula (V)
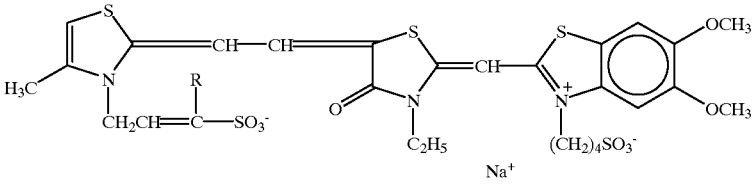
(V-1)
R = $CH_3$
(V-2)
R = 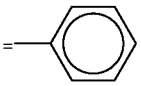
(V-3)
R = Br
(V-4)
R = Cl -continued
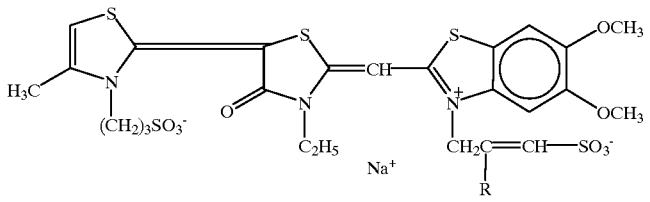
(V-5)
R = H
(V-6)
R = Br
(V-7)
R = Cl
(V-8)
R = $CH_3$
(V-9)
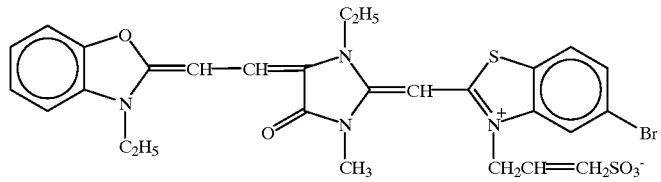
(V-10)
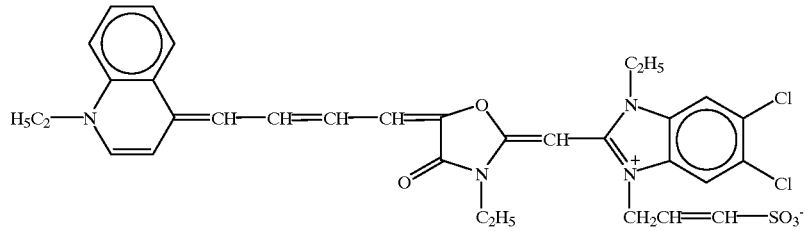
(V-11)
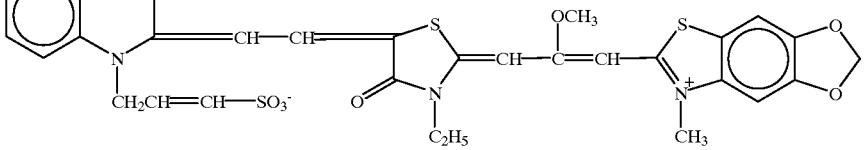
Specific examples of the compounds represented by general formula (II)
(II-1)
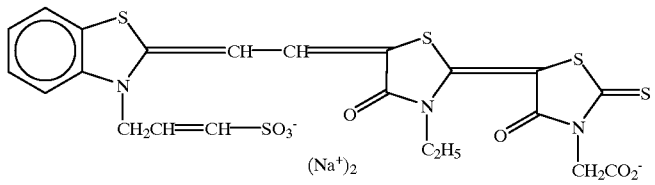

-continued (II-2)

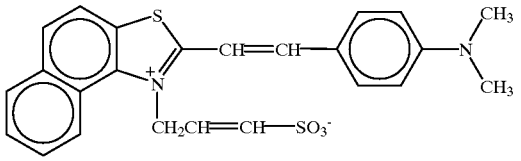

(II-3)

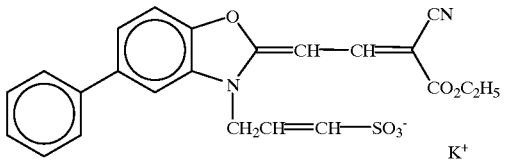

(II-4)

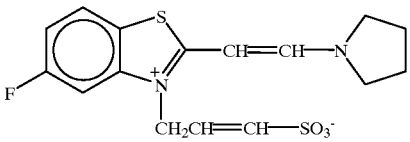

Specific examples of the compounds represented by general formula (I)

(I-1)

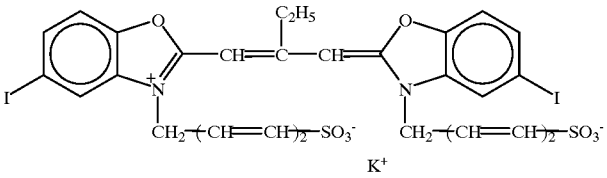

(I-2)

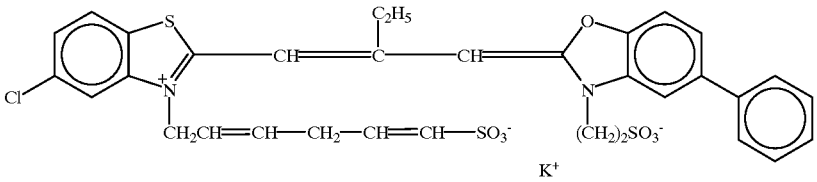

(I-3)

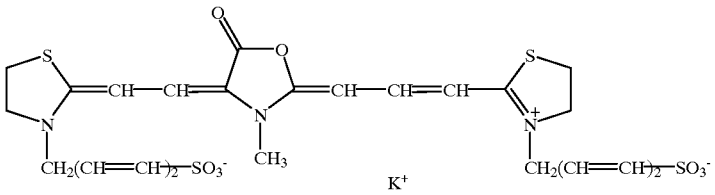

The compounds represented by general formula (I), which includes general formulae (II), (III), (IV), and (V), each of which is a narrower conception than that of general formula (I), for use in the present invention can be synthesized according to the methods as described by, for example, F. M. Harmer in *Heterocyclic Compounds—Cyanine Dyes and Related Compounds*, John Wiley & Sons Co., New York, London (1964); by D. M. Sturmer in *Heterocyclic Compounds—Special Topics in Heterocyclic Chemistry*, Chapter 18, Section 14, pp. 482 to 515, John Wiley & Sons Co., New York, London (1977); and described in *Rodd's Chemistry of Carbon Compounds*, 2nd Ed. Vol. IV, part B (1977), Chapter 15, pp. 369 to 422, Elservier Science Publishing Company Inc., New York; and British Patent No. 1,077,611.

Synthetic Example (Synthesis of Compound III-6)

Compound III-6 was prepared according to the following scheme:

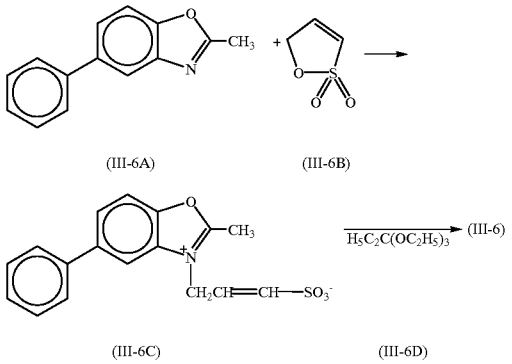

1.45 g (6.9 mmol) of compound (III-6A) and 0.83 g (6.9 mmol) of compound (III-6B) were heated, with stirring, on an oil bath at an outer temperature of 120° C., for 3 hours, and then 30 ml of ethyl acetate was added to the resultant reaction mixture, to precipitate crystals. The thus-obtained crystals were collected by means of suction filtration. After drying, 2 g of compound (III-6C) was obtained (yield 88%).

Subsequently, 2 g (6.1 mmol) of compound (III-6C), 5.5 ml of compound (III-6D), 3.5 ml of pyridine, 3.5 ml of acetic acid, and 1.7 ml of triethylamine were heated, with stirring, on an oil bath at an outer temperature of 150° C., for 2 hours, and then 30 ml of ethyl acetate was added to the resultant reaction mixture. The thus-obtained oily product was separated by decantation, and 20 ml of methanol and 0.45 g of potassium acetate were added to the separated oily product. The precipitated crystals were separated by suction filtration, and then 400 ml of methanol was added to these crystals. The resultant mixture was subjected to heat reflux, whereby the crystals were completely dissolved in methanol. The resultant solution was subjected to spontaneous filtration. Distillation of the filtrate under normal pressure removed 250 ml of a solvent. After that, the remaining filtrate was allowed to stand for cooling. The thus-obtained crystals were separated by suction filtration. After drying, 0.3 g of compound (III-6) was obtained. Yield 13.5%, $\lambda_{max}$=504 nm ($\epsilon$=133000) (in MeOH), Melting point: decomposition at 200° C. or more.

The amount of the spectral sensitizing dye represented by formula (I) to be added is preferably in the range of from $0.5\times10^{-6}$ mol to $1.0\times10^{-2}$ mol, and more preferably in the range of from $1.0\times10^{-5}$ mol to $5.0\times10^{-3}$ mol, per mol of silver halide. When a photographic light-sensitive material is composed of multiple silver halide emulsion layers, at least one of the silver halide emulsion layers is subjected to spectral sensitization using a spectral-sensitizing dye of general formula (I) for use in the present invention. Preferably, the above-mentioned spectral sensitization is applied to all of the silver halide emulsion layers in the photographic light-sensitive material.

A sensitizing dye may be added at the stage of the formation of silver halide grains, or at the stage of chemical sensitization, or at the time of coating.

In particular, with respect to a method in which a sensitizing dye is added during a formation of silver halide grains, U.S. Pat. Nos. 4,225,666 and 4,828,972, and JP-A No. 103149/1986 can be referred to. Further, with respect to a method in which a sensitizing dye is added at the stage of desalting for a silver halide emulsion, European Patent No. 291339A and JP-A No. 52137/1989 can be referred to. Further, with respect to a method in which a sensitizing dye is added in the stage of chemical sensitization, JP-A No. 48756/1984 can be referred to.

A method in which two or more kinds of sensitizing dyes are used in combination, is known as an effective way to increase spectral sensitivity by means of a sensitizing dye. When two or more kinds of sensitizing dyes are used in combination, the resulting spectral sensitivity is often an intermediate of the effects that would be obtained by respective use of each of the sensitizing dyes, or often the sensitivity decreases, as compared to the effects obtained by respective use of each of the sensitizing dyes. In contrast, when two or more kinds of sensitizing dyes are used in a particular combination, the spectral sensitivity sometimes greatly increases, as compared to the respective effects of each of them. Generally, this phenomenon is called a supersensitization (action) of sensitizing dyes. The supersensitization (action) is summarized in *The Theory of the Photographic Process*, edited by T. H. James, 4th Edition, Macmillan, New York (1977), Chapter 10 (coauthorship with W. West and P. B. Gilman).

When sensitizing dyes are used in combination, the resulting spectrally sensitized wavelength is sometimes intermediate between, or it may be the mere combination of, those obtained by use of each of the sensitizing dyes; or the spectral sensitization sometimes moves to the wavelength that would be scarcely expected from the characteristics of spectral sensitization obtained by use of each of the sensitizing dyes.

Accordingly, it has been an important subject in the technical field of spectral sensitization of a silver halide photographic emulsion to find a combination of spectral sensitizing dyes that provides not only higher spectral sensitivity than that attained by each of the spectral sensitizing dyes, but also spectrally sensitized wavelength regions that are suitable for use with regard to photographic light-sensitive materials.

For a combination of sensitizing dyes that is used to attain supersensitization, there is a mutually severe selectivity between the sensitizing dyes. Consequently, even a difference in a chemical structure that might seem trivial, greatly affects a supersensitization action. In other words, it is difficult to estimate whether a combination of sensitizing dyes will provide a supersensitization action, from only their chemical structures.

A supersensitizer may be a dye that itself provides no spectral sensitization action, or it may be a material that absorbs substantially no visible light. Examples of the supersensitizers include aminostyryl compounds substituted with a nitrogen-containing heterocyclic group (e.g. those described in U.S. Pat. Nos. 2,933,390 and 3,635,721), condensates of aromatic organic acids and formaldehyde (e.g. those described in U.S. Pat. No. 3,743,510), cadmium salts, and azaindene compounds. Such combinations described in U.S. Pat. Nos. 3,615,613, 3,615,641, 3,617,295, and 3,635,721 are especially useful.

The production steps of a silver halide emulsion are classified into the steps of grain formation, desalting, and chemical sensitization. The grain formation includes nucleus formation, ripening, and growth. These steps are not necessarily performed in this order, and the order of these steps may be reversed, or alternatively these steps may be repeated. The reduction sensitization for use in the present invention may be carried out during production steps of a silver halide emulsion, and this means the reduction sensitization may be, basically, carried out at any steps during the production steps. The reduction sensitization may be carried out at the time of the nucleus formation, which is an initial stage of the grain formation, or at the time of the physical ripening, or at the time of the growth, or alternatively in advance of, or after completion of, a chemical sensitization other than the reduction sensitization. When a chemical sensitization includes a gold sensitization, preferably the reduction sensitization is performed in advance of the chemical sensitization, so that undesirable fog will not occur. A method in which the reduction sensitization is conducted during the growth of silver halide grains is most preferred. The term "during the growth" referred to herein means that the above-mentioned method includes a method in which the reduction sensitization is carried out such that silver halide grains are physically ripening, or they are growing by the addition of a water-soluble silver salt and a water-soluble alkali halide, and also a method in which the reduction sensitization is effected such that the growth of silver halide grains is tentatively stopped during growth of the grains, and then the growth is further continued.

The reduction sensitization for use in the present invention includes such known methods as one in which a known reducing agent is added to a silver halide emulsion, a method in which silver halide grains are grown or ripened at a low-pAg atmosphere of from 1 to 7, which is called "silver ripening," and a method in which silver halide grains are grown or ripened at a high-pH atmosphere of from 8 to 11, which is called "high-pH ripening." Further, two or more of these methods may be used in combination.

A method in which a reduction sensitizer is added to a silver halide emulsion, is preferred from the viewpoint that the level of the reduction sensitization can be minutely controlled.

For use as a reduction sensitizer, stannous salts, amines and polyamines, hydrazine derivatives, formamidinesulfinic acid, silane compounds, borane compounds, and the like are known. The reduction sensitizer for use in the present invention may be selected from these known compounds. Further, two or more kinds of these compounds may be used in combination. Preferred of these reduction sensitizers are stannous chloride, thiourea dioxide, dimethylamineborane, and an alkynylamine compound described in U.S. Pat. No. 5,389,510, with thiourea dioxide more preferred. The amount of the reduction sensitizer to be added is determined depending on the condition for the production of a silver halide emulsion, but suitably it is in the range of from $10^{-7}$ mole to $10^{-3}$ mole, per mole of silver halide.

Ascorbic acids and its derivatives can also be used as a reduction sensitizer for use in the present invention.

Specific examples of ascorbic acids and its derivatives (hereinafter referred to as ascorbic acid compounds) are illustrated below.

| | |
|---|---|
| (A-1) | L-ascorbic acid |
| (A-2) | Sodium L-ascorbate |
| (A-3) | Potassium L-ascorbate |
| (A-4) | DL-ascorbic acid |
| (A-5) | Sodium D-ascorbate |
| (A-6) | L-ascorbic acid-6-acetate |
| (A-7) | L-ascorbic acid-6-palmitate |
| (A-8) | L-ascorbic acid-6-benzoate |
| (A-9) | L-ascorbic acid-5,6-diacetate |
| (A-10) | L-ascorbic acid-5,6-O-isopropylidene |

Desirably, ascorbic acid compounds for use in the present invention are used in a larger amount than that in which a reduction sensitizer is preferably used hitherto. For example, JP-B No. 33572/1982 describes that the amount of a reduction sensitizer is usually not more than $0.75\times10^{-2}$ milliequivalents, per g of silver ion ($8\times10^{-4}$ mol/AgX mol), and the amount of 0.1 to 10 mg, per kg of silver nitrate ($10^{-7}$ to $10^{-5}$ mol, per mol of AgX in terms of ascorbic acid) is effective in many cases (the conversion values in parentheses were calculated by the present inventors). U.S. Pat. No. 2,487,850 describes that the amount of a tin compound to be added for use as a reduction sensitizers is in the range of from $1\times10^{-7}$ mol to $44\times10^{-6}$ mol. Further, JP-A No. 179835/1982 describes that the addition amount of thioureadioxide to be used is suitably in the range of from about 0.01 mg to about 2 mg, per mol of silver halide, and stannous chloride is suitably used in the range of from about 0.01 mg to about 3 mg, per mol of silver halide. The preferable addition amount of the ascorbic acid compound for use in the present invention varies depending on such factors as the grain size of a photographic emulsion, the halogen composition, and the temperature, pH, or pAg at the time of preparation of a photographic emulsion, but preferably the amount of the ascorbic acid compound is selected from the range of from $5\times10^{-5}$ to $1\times10^{-1}$ mol, more preferably from $5\times10^{-4}$ mol to $1\times10^{-2}$ mol, and particularly preferably from $1\times10^{-3}$ mol to $1\times10^{-2}$ mol, per mol of silver halide. Thiourea dioxide is particularly preferably among the reduction sensitizers.

A reduction sensitizer may be added to an emulsion during the formation of silver halide grains, or alternatively before or after the completion of chemical sensitization, in the form of a solution having the reduction sensitizer dissolved in water or such a solvent as alcohols, glycols, ketones, esters, and amides. The time when the reduction sensitizer is added to the emulsion may be any stage during preparation of the emulsion, but especially preferably the reduction sensitizer is added during the formation of silver halide grains. The reduction sensitizer may be added to a reaction vessel in advance, but preferably the reduction sensitizer is added at any proper stage during the formation of silver halide grains. Alternatively, use can be made of a method in which the reduction sensitizer is added to an aqueous solution of a water-soluble silver salt, or a water-soluble alkali halide in advance, and then grain formation is performed using these aqueous solutions. Further, a method in which a solution of the reduction sensitizer is added in parts and/or successively for a long period of time during the formation of silver halide grains, is also preferred.

Preferably, an oxidizing agent for silver is used during preparation of the emulsion for use in the present invention. The term "an oxidizing agent for silver" means a compound that is able to convert a metal silver to a silver ion. Especially effective, of these oxidizing agents, is a compound that is able to convert extremely fine silver grains that are formed as a by-product during formation of silver halide grains and chemical sensitization, into silver ions. The thus-converted silver ions may form a silver salt that is sparingly soluble in water, which salt may be silver halide, silver sulfide, and silver selenide, or alternatively they may form a silver salt that is easily soluble in water, which salt may be silver nitrate. The oxidizing agent for silver may be an inorganic substance or an organic substance. Examples of the inorganic oxidizing agent include ozone, hydrogen peroxide and its adduct (e.g. $NaBO_2.H_2O_2.3H_2O$, $2Na_2CO_3.3H_2O_2$, $Na_4P_2O_7.2H_2O_2$, and $2Na_2SO_4.H_2O_2.2H_2O$); oxyacid salts, such as peroxyacid salts (e.g. $K_2S_2O_8$, $K_2C_2O_6$, and $K_2P_2O_8$), peroxy complex compounds {e.g. $K_2(Ti(O_2)C_2O_4).3H_2O$, $4K_2SO_4.Ti(O_2)OH.SO_4.2H_2O$, and $Na_3(VO(O_2)(C_2H_4)_26H_2O$}, permanganates (e.g. $KMnO_4$), and chromates (e.g. $K_2Cr_2O_7$); halogen elements, such as iodine and bromine; perhalogenic acid salts (e.g. potassium periodate); high valence metal salts (e.g. potassium hexacyanoferrate), and thiosulfates. Further, examples of organic oxidizing agents include quinones, such as p-quinone; organic peroxides, such as peracetic acid and perbenzoic acid, and compounds that release an active halogen (e.g. N-bromosuccineimide, chloramine T, and chloramine B).

Further, preferable oxidizing agents to be used are disulfide compounds described in European Patent No. 0627657A2.

Further, preferable examples of the oxidizing agents for use in the present invention also include inorganic oxidizing agents selected from ozone, hydrogen peroxide and its adducts, halogen elements, and thiosulfonates; and organic oxidizing agents selected from quinones. In a preferable embodiment, the above-described reduction sensitization is effected in combination with an oxidizing agent for silver. Use can be made of a method in which reduction sensitization is effected after use of the oxidizing agent, a method in which the oxidizing agent is used after completion of the reduction sensitization, or alternatively a method in which reduction sensitization is effected in the presence of the oxidizing agent. These methods can be used in either the step of grain formation or the step of chemical sensitization, whichever is preferable according to the occasion.

A silver halide photographic light-sensitive material of the present invention preferably contains at least one compound selected from compounds represented by the following general formula (XX), (XXI), or (XXII):

General formula (XX)

$$R_{101}—SO_2S—M_{101}$$

General formula (XXI)

$$R_{101}—SO_2S—R_{102}$$

General formula (XXII)

$$R_{101}—SO_2S—(E)_a—SSO_2—R_{103}$$

wherein $R_{101}$, $R_{102}$, and $R_{103}$ each represent an aliphatic group, an aromatic group, or a heterocyclic group; $M_{101}$ represents a cation, E represents a divalent linking group, and a is 0 or 1.

The compounds of the general formula (XX), (XXI), or (XXII) are described in more detail below.

When $R_{101}$, $R_{102}$, and $R_{103}$ each represent an aliphatic group, they are preferably an alkyl group having 1 to 22 carbon atoms, an alkenyl group having 2 to 22 carbon atoms, or an alkynyl group having 2 to 22 carbon atoms, each of which may be substituted with a substituent. Examples of the alkyl group include a methyl group, an ethyl group, a propyl group, a butyl group, a pentyl group, a hexyl group, an octyl group, a 2-ethylhexyl group, a decyl group, a dodecyl group, a hexadecyl group, an octadecyl group, a cyclohexyl group, an isopropyl group, and a t-butyl group.

Examples of the alkenyl group include an allyl group and a butenyl group.

Examples of the alkynyl group include a propargyl group and a butynyl group.

The aromatic group represented by $R_{101}$, $R_{102}$, and $R_{103}$ preferably has 6 to 20 carbon atoms, and examples include a phenyl group and a naphthyl group, each of which may be substituted with a substituent.

The heterocyclic group represented by $R_{101}$, $R_{102}$, and $R_{103}$ is preferably a 3- to 15-membered heterocyclic group containing at least one element selected from nitrogen, oxygen, sulfur, selenium, and tellurium. Examples of the heterocyclic ring include a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tellurazole ring, a triazole ring, a benzotriazole ring, a tetrazole ring, an oxadiazole ring, and a thiadiazole ring.

Examples of the substituent for $R_{101}$, $R_{102}$, and $R_{103}$ include an alkyl group (e.g. methyl, ethyl, and hexyl), an alkoxy group (e.g. methoxy, ethoxy, and octyloxy), an aryl group (e.g. phenyl, naphthyl, and tolyl), a hydroxyl group, a halogen atom (e.g. fluorine, chlorine, bromine, iodine), an aryloxy group (e.g. phenoxy), an alkylthio group (e.g. methylthio and butylthio), an arylthio group (e.g. phenylthio), an acyl group (e.g. acetyl, propionyl, butyryl, and valeryl), a sulfonyl group (e.g. methylsulfonyl and phenylsulfonyl), an acylamino group (e.g. acetylamino and benzamino), a sulfonylamino group (e.g. methanesulfonylamino and benzenesulfonylamino), an acyloxy group (e.g. acetoxy and benzoxy), a carboxyl group, a cyano group, a sulfo group, and an amino group.

E is preferably a divalent aliphatic or aromatic group. Examples of the divalent aliphatic group represented by E include $—(CH_2)_n—$ (n represents an integer of 1 to 12), $—CH_2—CH=CH—CH_2—$,

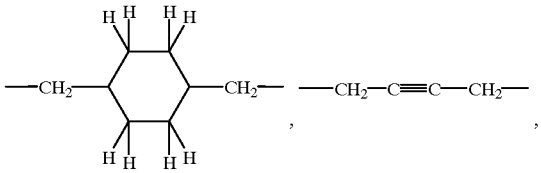

and a xylylene group. Examples of the divalent aromatic group represented by E include a phenylene group and a naphthylene group.

These groups may also be substituted with such substituents as those for V-1 to V-4 described hereinbefore.

$M_{101}$ is preferably a metallic ion or an organic cation. Examples of the metallic ion include alkali metal ions, such as, a lithium ion, a sodium ion, and a potassium ion. Examples of the organic cation include ammonium ions (e.g. ammonium, tetramethyl ammonium, and tetrabutyl ammonium), phosphonium ions (e.g. tetraphenylphosphonium), and a guanidine group.

Specific examples of the compound represented by general formula (XX), (XXI), or (XXII) are illustrated below, but the present invention is not limited to the compounds shown.

(XX-1)

$CH_3SO_2SNa$ (XX-2)

$C_2H_5SO_2SNa$ (XX-3)

$C_3H_7SO_2SK$ (XX-4)

$C_4H_9SO_2SLi$ (XX-5)

$C_6H_{13}SO_2SNa$

-continued
(XX-6)
$C_8H_{17}SO_2SNa$
(XX-7)
$CH_3(CH_2)_3CH(C_2H_5)CH_2SO_2S.NH_4$
(XX-8)
$C_{10}H_{21}SO_2SNa$
(XX-9)
$C_{12}H_{25}SO_2SNa$
(XX-10)
$C_{16}H_{33}SO_2SNa$
(XX-11)
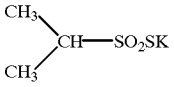
(XX-12)
t-$C_4H_9SO_2SNa$
(XX-13)
$CH_3OCH_2CH_2SO_2S.Na$
(XX-14)
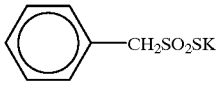
(XX-15)
$CH_2{=}CHCH_2SO_2SNa$
(XX-16)
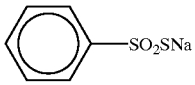
(XX-17)
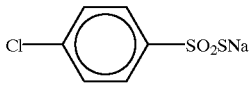
(XX-18)
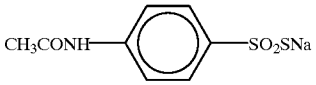
(XX-19)
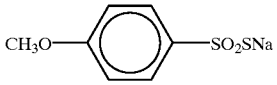
(XX-20)
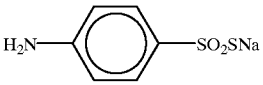
-continued
(XX-21)
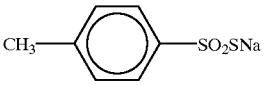
(XX-22)
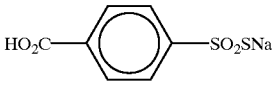
(XX-23)
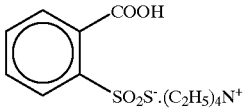
(XX-24)
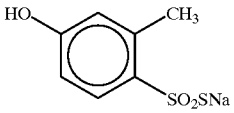
(XX-25)
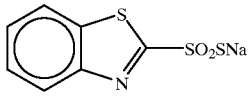
(XX-26)
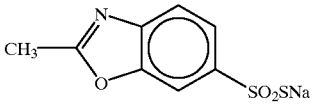
(XX-27)
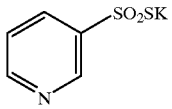
(XX-28)
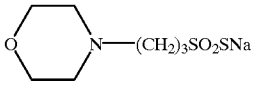
(XX-29)
$KSSO_2(CH_2)_2SO_2SK$
(XX-30)
$NaSSO_2(CH_2)_4SO_2SNa$
(XX-31)
$NaSSO_2(CH_2)_4S(CH_2)_4SO_2SNa$
(XX-32)
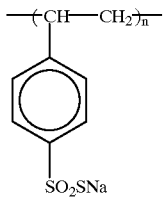

-continued
(XX-33)
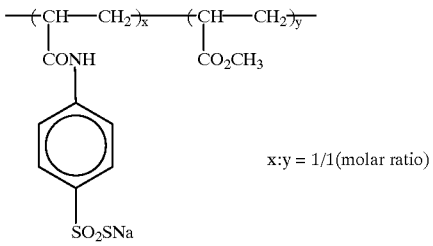
x:y = 1/1(molar ratio)
(XXI-1)
$C_2H_5SO_2S—CH_3$
(XXI-2)
$C_8H_{17}SO_2SCH_2CH_3$
(XXI-3)
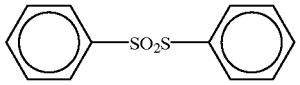
(XXI-4)
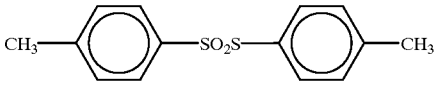
(XXI-5)
$C_2H_5SO_2SCH_2CH_2CN$
(XXI-6)
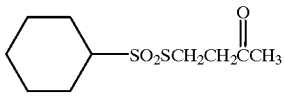
(XXI-7)
$C_4H_9SO_2SCH(CH_3)CH_2CN$
(XXI-8)
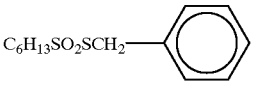
(XXI-9)
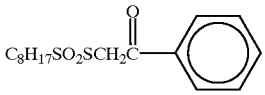
(XXI-10)
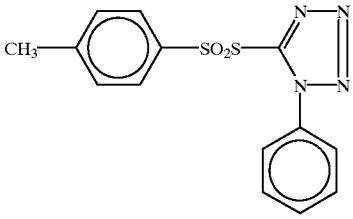
-continued
(XXI-11)
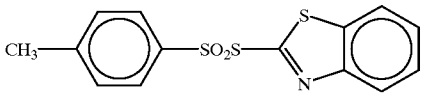
(XXI-12)
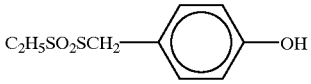
(XXI-13)
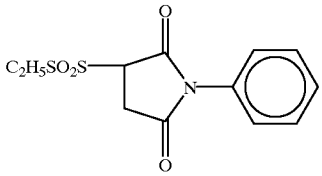
(XXI-14)
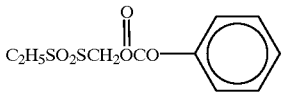
(XXI-15)
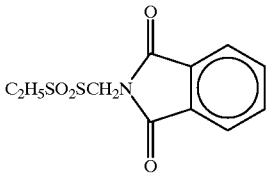
(XXI-16)
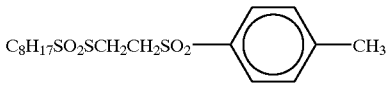
(XXI-17)
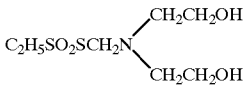
(XXI-18)
$C_2H_5SO_2SCH_2CH_2CH_2CH_2OH$
(XXI-19)
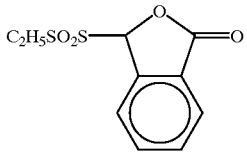
(XXI-20)
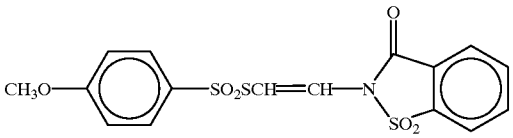
(XXI-21)
$CH_3SSO_2(CH_2)_4SO_2SCH_3$ -continued (XXI-22)

$CH_3SSO_2(CH_2)_2SO_2SCH_3$ (XXI-23)

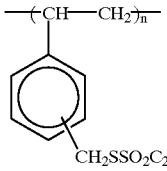

(XXI-24)

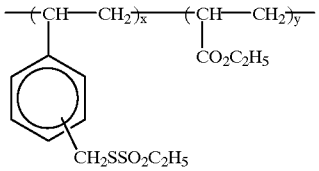

x:y = 2/1(molar ratio)

(XXI-25)

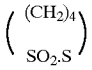

(XXII-1)

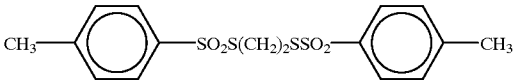

(XXII-2)

$C_2H_5SO_2SCH_2CH_2SO_2CH_2CH_2SSO_2C_2H_5$ (XXII-3)

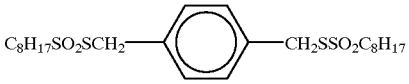

(XXII-4)

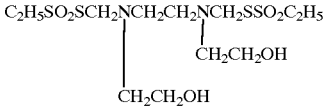

(XXII-5)

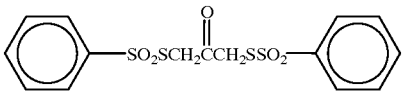

(XXII-6)

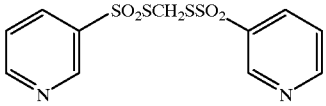

(XXII-7)

$C_2H_5SO_2SSSO_2C_2H_5$ (XXII-8)

$(n)C_3H_7SO_2SSSO_2C_3H_7(n)$

-continued (XXII-8)

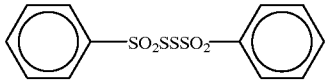

The compound of general formula (XX) can be prepared with ease according to the methods described in JP-A No. 1019/1979 and British Patent No. 972,211.

The addition amount of the compound represented by general formula (XX), (XXI), or (XXII) is preferably from $10^{-7}$ mol to $10^{-1}$ mol, more preferably from $10^{-6}$ mol to $10^{-2}$ mol, and especially preferably from $10^{-5}$ mol to $10^{-3}$ mol, per mol of silver halide.

The compound represented by general formula (XX), (XXI), or (XXII) can be added during preparation of a photographic light-sensitive material by a conventional method that is used to add additives to a photographic emulsion. For example, a water-soluble compound can be added in the form of an aqueous solution having a suitable concentration of the compound. On the other hand, a water-insoluble or water-sparingly-soluble compound can be added in the form of a solution having the compound dissolved in a suitable water-missible organic solvent that does not adversely affect photographic properties, which solvent may be selected from alcohols, glycols, ketones, esters, amides, and the like.

The time when a compound represented by general formula (XX), (XXI), or (XXII) is added to a silver halide emulsion may be any stage during preparation of the emulsion, i.e. during grain formation or before or after the chemical sensitization. Preferably the compound is added before or during reduction sensitization. Especially preferably the compound is added during growth of the grains.

The compound may be added to a reaction vessel in advance, but the compound is preferably added at any suitable stage during formation of the grains. Further, the compound represented by general formula (XX), (XXI), or (XXII) may be added to an aqueous solution of a water-soluble silver salt, or a water-soluble alkali halide, in advance of the grain formation that will be performed using these aqueous solutions. Further, a method in which a solution containing the compound represented by general formula (XX), (XXI), or (XXII) is added in parts and/or successively for a long period of time during grain formation, is also preferred.

Most preferred in the present invention among compounds represented by general formula (XX), (XXI), or (XXII), are those represented by general formula (XX).

Use of the photographic light-sensitive materials of the present invention is not limited in particular, but they are used as, for example, a color negative film, a color positive film, a black/white photographic material, a negative film for a motion picture, and a positive film for a motion picture. The photographic light-sensitive material of the present invention essentially has at least one light-sensitive layer that is coated on a support. A typical example of the photographic light-sensitive material is a silver halide photographic light-sensitive material that has, on a support, at least one light-sensitive layer composed of two or more kinds of silver halide emulsion layers, each of which emulsion layers has substantially the same color-sensitive region, but the emulsion layers have different speeds (sensitivities) from each other. The above-said light-sensitive layer is generally a unit light-sensitive layer that is sensitive to any one color of a blue light, a green light, and a red light. With respect to a multi-layered silver halide color photographic light-sensitive material, the configuration of unit light-sensitive layers is generally that the red-sensitive layer is closest to the support, then comes the green-sensitive layer, and then comes the blue-sensitive layer (i.e. the blue-sensitive layer is furthest from the support). However, the above-described configuration may be reversed according to use of the photographic light-sensitive material. Alternatively, such a configuration as that a light-sensitive layer having a different color-sensitive region is sandwiched between two light-sensitive layers, each of which has the same color-sensitive region, can also be used. A light-insensitive layer may be applied between the above-described silver halide light-sensitive layers, and/or for use as an uppermost layer, or as a bottom layer. These layers may contain a coupler, a DIR compound, a color mixing-preventing agent, and the like, as described below. Two or more kinds of silver halide emulsion layers that constitute each of the unit light-sensitive layers are preferably configurated in the order of a high-sensitive emulsion layer and a low-sensitive emulsion layer from a support, so that the sensitivities of these emulsion layers successively become lower in the direction toward the support, as described in German Patent No. 1,121,470 and British Patent No. 923, 045. Further, a low-sensitive emulsion layer at the position further from a support, and a high-sensitive emulsion layer nearer the support, can also be set, as described in JP-A Nos. 112751/1982, 200350/1987, 206541/1987, and 206543/1987.

Specific examples of the order include an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), an order of BH/BL/GL/GH/RH/RL, and an order of BH/BL/GH/GL/RL/RH, stated from the side away from the support.

As described in JP-B No. 34932/1980, an order of a blue-sensitive layer/GH/RH/GL/RL stated from the side away from the support is also possible. Further as described in JP-A Nos. 25738/1981 and 63936/1987, an order of a blue-sensitive layer/GL/RL/GH/RH stated from the side away from the support is also possible.

Further as described in JP-B No. 15495/1974, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A No. 202464/1984.

Further, for example, an order of a high-sensitive emulsion layer/low-sensitive emulsion layer/medium-sensitive emulsion layer or an order of a low-sensitive emulsion layer/medium-sensitive emulsion layer/high-sensitive emulsion layer can be taken. In the case of four layers or more layers, the arrangement can be varied as above.

In order to improve color reproducibility, a donor layer (CL), for use to attain an interlayer effect, whose spectral sensitivity distribution is different from that of such main light-sensitive layers as BL, GL, and RL, is preferably set adjacent to or near the main light-sensitive layer, as described in U.S. Pat. Nos. 4,663,271, 4,705,744, and 4,707, 436, and in JP-A Nos. 160448/1987 and 89850/1988.

Preferable silver halide to be used in the present invention is silver iodobromide, silver iodochloride, and silver iodochlorobromide, containing about 30 mol % or less silver iodide. A particularly preferable silver halide is silver iodobromide and silver iodochlorobromide, containing about 2 to about 10 mol % silver iodide.

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form of these.

The silver halide grains may be fine grains having a diameter of about 0.2 $\mu$m or less, or large-size grains with the diameter of the projected area being down to about 10 $\mu$m. As the silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types*, in *Research Disclosure* (RD) No. 17643 (December 1978), pp. 22–23, and ibid. No. 18716 (November 1979), p. 648, and ibid. No. 307105 (November, 1989), pp. 863–865; the methods described by P. Glafkides, in *Chimie et Phisique Photographique*, Paul Montel (1967), by G. F. Duffin, in *Photographic Emulsion Chemistry*, Focal Press (1966), and by V. L. Zelikman et al., in *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable.

Further, tabular grains having an aspect ratio of about 3 or more can be used in the present invention. Tabular grains can be easily prepared by methods described, for example, by Gutof in "Photographic Science and Engineering", Vol. 14, page 248 to 257 (1970); and in U.S. Pat. Nos. 4,434,226, 4,414,310, 4,433,048, and 4,439,520, and British Patent No. 2,112,157.

The crystals may have a uniform crystal structure, or the crystals may have a different halogen composition structure, in which the halogen composition is different between the inside and the outside of the crystals, or the crystals may have a layered structure. A silver halide having a different halogen composition may be joined on the host silver halide grains by epitaxial growth, or alternatively such a compound other than silver halide like silver rhodanide and lead oxide, may be joined on the silver halide grains. Further, a mixture of grains having various kinds of crystal forms may be used.

The above-described emulsion may be any of a surface latent image-type emulsion, wherein a latent image is mainly formed on the grain surface; an internal latent image-type emulsion, wherein a latent image is formed inside the grain; and another type of emulsion, wherein a latent image is formed both on the grain surface and inside the grain; but in any case the above-described emulsion must be a negative-working emulsion. The internal latent image-type emulsion may be a core/shell-type emulsion, as described in JP-A No. 264740/1988. A method of preparing the core/shell-type, internal latent image-type emulsion is described in JP-A No. 133542/1984. The thickness of shells of the core/shell grains is different due to such conditions as the development process, but preferably it is from 3 nm to 40 nm, and particularly preferably from 5 to 20 nm.

The silver halide emulsion for use in the present invention is generally subjected to physical ripening, chemical ripening, and spectral sensitization. Additives that are used in these steps are described in RD Nos. 17643, 18716, and 307105, whose appropriate portions are compiled in a table shown below.

In the light-sensitive material of the present invention, a mixture of two or more kinds of light-sensitive silver halide emulsions, each of which has at least one different property in terms of grain size, grain size distribution, halogen composition, shape of the grain, and sensitivity, can be used in the same layer.

Silver halide grains whose surface was previously fogged, as described in U.S. Pat. No. 4,082,553; silver halide grains whose internal portion was previously fogged, as described in U.S. Pat. No. 4,626,498 and JP-A No. 214852/1984, or a colloidal silver, may be preferably applied to a light-sensitive silver halide emulsion layer and/or a substantially non-light-sensitive hydrophilic colloid layer. The silver halide grains whose inside or surface was previously fogged means silver halide grains that are developable uniformly (non-image wise) without a distinction of an unexposed part and an exposed part of the photosensitive material. A method of preparing silver halide grains whose inside or surface is previously fogged is described in U.S. Pat. No. 4,626,498 and JP-A No. 214852/1984. Silver halides that form internal nuclei of the core/shell-type silver halide grains whose inside is previously fogged may be those having the same halogen composition or those having different halogen compositions. As a silver halide whose inside or surface of grain is previously fogged, any of silver chloride, silver chlorobromide, silver iodobromide, and silver chloroiodobromide can be used. Sizes of these previously fogged silver halide grains are not limited in particular, but an average grain size thereof is preferably from 0.01 μm to 0.75 μm, and particularly preferably from 0.05 μm to 0.6 μm. Further, a grain shape is not limited in particular, and grains may be regular in shape. Moreover, these emulsions may be a poly-dispersion emulsion, but a mono-dispersion emulsion (at least 95% of silver halide grains in weight or number have grain diameters within ±40% of the average grain diameter) is preferred.

In the present invention, it is preferable to use a light-insensitive fine-grain silver halide. A light-insensitive fine-grain silver halide means silver halide fine particles that are not sensitive to light at an image-wise exposure to light for obtaining a dye image, and that are not substantially developable in a developing process. Preferably these silver halide grains are not previously fogged. These fine-grain silver halides are those having a silver bromide content of from 0 mol % to 100 mol %; they may optimally contain silver chloride and/or silver iodide. Preferably they contain 0.5 mol % to 10 mol % of silver iodide. The average grain size (the average diameter of a circle having the same area as the projected area of the grains) of fine-grain silver halides is preferably from 0.01 μm to 0.5 μm, and more preferably from 0.02 μm to 2 μm.

Fine-grain silver halides can be prepared in the same manner as a method of producing a usual light-sensitive silver halide. It is not necessary to photographically sensitize the surface of these fine-grains. Further, spectral sensitization is also not necessary. However, preferably, such a known stabilizer as triazole-series compounds, azaindene-series compounds, benzothiazolium-series compounds, mercapto-series compounds, and zinc compounds, is previously added to the fine-grain silver halide emulsion, in advance of adding the emulsion to a coating solution. Colloidal silver may be incorporated in a layer containing the said fine-grain silver halide.

The coating silver amount of the light-sensitive material of the present invention is preferably not more than 6.0 g/m$^2$, and most preferably not more than 4.5 g/m$^2$.

Other photographic additives that can be used in the present invention are also described in the above-described RDs, whose appropriate portions are shown in the following table:

| | Additive | RD 17643 (December, 1978) | RD 18716 (November, 1979) | RD 307105 (November, 1989) |
|---|---|---|---|---|
| 1 | Chemical sensitizer | p. 23 | p. 648 (right column) | p. 886 |
| 2 | Sensitivity-enhancing agent | — | p. 648 (right column) | — |
| 3 | Spectral sensitizers and Supersensitizers | pp. 23–24 | pp. 648 (right column)–649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants | p. 27 | p. 650 (right column) | pp. 876 |
| 12 | Coating aids and Surface-active agents | pp. 26–27 | p. 650 (right column) | pp. 875–876 |
| 13 | Antistatic agents | p. 27 | p. 650 (right column) | pp. 876–877 |
| 14 | Matting agent | — | — | pp. 878 –879 |

Various kinds of dye-forming couplers can be used in the light-sensitive material of the present invention. Particularly preferred of these couplers are those as described below.

Yellow couplers:

couplers represented by formula (I) or (II) of European Patent No. 502,424A; couplers represented by formula (1) or (2) of European Patent No. 513,496A (especially Y-28 on page 18); couplers represented by formula (I) in claim 1 of European Patent No. 568,037A; couplers represented by general formula (I) in column 1, lines 45 to 55, of U.S. Pat. No. 5,066,576; couplers represented by general formula (I), at paragraph 0008, of JP-A No. 274425/1992; couplers described in claim 1, on page 40, of European Patent No. 498,381A1 (especially D-35 on page 18); couplers represented by formula (Y), on page 4, of European Patent No. 447,969A1 (especially Y-1 on page 17, and Y-54 on page 41); and couplers represented by formula (II) to (IV) in column 7, lines 36 to 58, of U.S. Pat. No. 4,476,219 (especially II-17, and II-19 in column 17, and II-24 in column 19).

Magenta couplers:

L-57 on page 11, right lower column, and L-68 on page 12, right lower column, and L-77 on page 13, right lower column of JP-A No. 39737/1991; [A-4]-63 on page 134, and [A-4]-73, -75 on page 139, of European Patent No. 456,275; M-4, -6 on page 26, and M-7 on page 27, of European Patent No. 486,965; M-45 on page 19 of European Patent No. 571,959A; M-1 on page 6 of JP-A No. 204106/1993; and M-22 in paragraph 0237 of JP-A No. 362631/1992.

Cyan couplers:

CX-1, -3, -4, -5, -11, -12, -14, and -15 on pages 14 to 16 of JP-A No.204843/1992; C-7 and -10 on page 35, C-34 and -35 on page 37, (I-1), and (I-17) on pages 42 to 43, of JP-A No. 43345/1992; and couplers represented by general formula (Ia) or (Ib) in claim 1 of JP-A No. 67385/1994.

Polymer couplers:

P-1 and P-5 on page 11 of JP-A No. 44345/1990.

Preferred of couplers that provide colored dyes having a moderate diffusibility, are those described in U.S. Pat. No. 4,366,237, GB Patent No. 2,125,570, European Patent No. 96,873B, and DE Patent No. 3,234,533.

Preferable examples of the couplers that are used to correct an unnecessary absorption of the colored dye include yellow-colored cyan couplers represented by formula (CI), (CII), (CIII), or (CIV) on page 5 of European Patent No. 456,257A1 (especially YC-86 on page 84); yellow-colored magenta couplers ExM-7 on page 202, EX-1 on page 249, and EX-7 on page 251, of the above-described European Patent No. 456,257A1; magenta-colored cyan couplers CC-9 in column 8, and CC-13 in column 10, of U.S. Pat. No. 4,833,069; and colorless masking couplers (2) in column 8 of U.S. Pat. No. 4,837,136, as well as those represented by formula (A) in claim 1 of WO 92/11575 (especially exemplified compounds in pages 36 to 45).

Examples of the compounds (including couplers) capable of releasing a residue of a photographically useful compound, when reacted with the oxidation product of a developing agent, include the following compounds.

Development inhibitor-releasing compounds: compounds represented by formula (I), (II), (III), or (IV) on page 11 of European Patent No. 378,236A1 (especially T-101 on page 30, T-104 on page 31, T-113 on page 36, T-131 on page 45, T-144 on page 51, and T-158 on page 58); compounds represented by formula (I) described on page 7 of European Patent No. 436,938A2 (especially D-49 on page 51); compounds represented by formula (I) of European Patent No. 568,037A (especially (23) on page 11); compounds represented by formula (I), (II), or (III), described on pages 5 to 6 of European Patent No. 440,195A2 (especially I-(1) on page 29); Breach accelerator-releasing compounds: compounds represented by formula (I) or (I') on page 5 of European Patent No. 310,125A2 (especially (60) and (61) on page 61), and compounds represented by formula (I) in claim 1 of JP-A No. 59411/1994 (especially (7) on page 7); Ligand-releasing compounds: compounds represented by LIG-X described in claim 1 of U.S. Pat. No. 4,555,478 (especially compounds described in column 12, lines 21 to 41); Leuco dye-releasing compounds: compounds 1 to 6 in columns 3 to 8 of U.S. Pat. No. 4,749,641; Fluorescence dye-releasing compounds: compounds represented by COUP-DYE in claim 1 of U.S. Pat. No. 4,774,181 (especially compounds 1 to 11 in columns 7 to 10); Development accelerator- or fogging agent-releasing compounds: compounds represented by formula (1), (2), or (3) in column 3 of U.S. Pat. No. 4,656,123 (especially (I-22) in column 25), and ExZK-2 on page 75, lines 36 to 38, of European Patent No. 450,637A2; Compounds capable of releasing a group that will become a dye after leaving from the compound: compounds represented by formula (I) in claim 1 of U.S. Pat. No. 4,857,447 (especially Y-1 to Y-19 in columns 25 to 36).

Preferable examples of additives other than couplers are described below.

Dispersion mediums for oil-soluble organic compounds: P-3, -5, -16, -19, -25, -30, -42, -49, -54, -55, -66, -81, -85, -86, and -93 on pages 140 to 144 of JP-A No. 215272/1987; Latexes for impregnation of oil-soluble organic compounds: latexes described in U.S. Pat. No. 4,199,363; Scavengers of the oxidation product of a developing agent: compounds represented by formula (I) in column 2, lines 54 to 62, of U.S. Pat. No. 4,978,606 (especially I-(1), -(2), -(6), and -(12) in columns 4 to 5), and compounds represented by the formula in column 2, lines 5 to 10, of U.S. Pat. No. 4,923,787 (especially compound 1 in column 3); Antistain agents: compounds represented by formula (I), (II), or (III) on page 4, lines 30 to 33, of European Patent No. 298,321A (especially I-47, -72, III-1, and -27 on pages 24 to 48); Antifading agents: A-6, -7, -20, -21, -23, -24, -25, -26, -30, -37, -40, -42, -48, -63, -90, -92, -94, and -164 on pages 69 to 118 of European Patent No. 298,321A, II-1 to III-23 in columns 25 to 38 of U.S. Pat. No. 5,122,444 (especially III-10), I-1 to III-4 on pages 8 to 12 of European Patent No. 471,347A (especially II-2), and A-1 to -48 in columns 32 to 40 of U.S. Pat. No. 5,139,931 (especially A-39, -42); Materials capable of reducing an amount of a coloring enhancer or a color mixing-preventing agent to be used: I-1 to II-15 on pages 5 to 24 of European Patent No. 411,324A (especially I-46); Formalin scavengers: SCV-1 to -28 on pages 24 to 29 of European Patent No. 477,932A (especially SCV-8); Hardening agents: H-1, -4, -6, -8, and -14 on page 17 of JP-A No. 214845/1989, compounds represented by formula (VII) to (XII) in columns 13 to 23 of U.S. Pat. No. 4,618,573 (especially H-1 to -54), compounds represented by formula (6) on page 8, right lower column, of JP-A No. 214852/1990 (H1 to -76, especially H-14), and compounds described in claim 1 of U.S. Pat. No. 3,325,287; Precursors of a development-inhibiting agent: P-24, -37, and -39 on pages 6 to 7 of JP-A No. 168139/1987, and compounds described in claim 1 of U.S. Pat. No. 5,019,492 (especially 28, 29 in column 7); Antiseptics or Anti-molding agents: I-1 to III-43 in columns 3 to 15 of U.S. Pat. No. 4,923,790 (especially II-1, -9, -10, -18, and III-25); Stabilizers or Antifogging agents: I-1 to (14) in columns 6 to 16 of U.S. Pat. No. 4,923,793 (especially I-1, -60, (2), and (13)), and compounds 1 to 65 in columns 25 to 32 of U.S. Pat. No. 4,952,483 (especially 36); Chemical sensitizers: triphenyl phosphine selenide, and compound 50 of JP-A No. 40324/1993; Dyes: a-1 to b-20 on pages 15 to 18 (especially a-1, -12, -18, -27, -35, -36, and b-5), and V-1 to -23 on pages 27 to 29 (especially V-1), of JP-A No. 156450/1991, F-I-1 to F-II-43 on pages 33 to 55 of European Patent No. 445,627A (especially F-I-11 and F-II-8), III-1 to -36 on pages 17 to 28 of European Patent No. 457,153A (especially III-1, and -3), fine crystal dispersions of Dye-1 to -124 on pages 8 to 26 of WO 88/04794, compounds 1 to 22 on pages 6 to 11 of European Patent No. 319,999A (especially compound 1), compounds D-1 to -87 (of formula (1), (2) or (3)) on pages 3 to 28 of European Patent No. 519,306A, compounds 1 to 22 (of formula (I)) in columns 3 to 10 of U.S. Pat. No. 4,268,622, and compounds (1) to (31) (of formula (I)) in columns 2 to 9 of U.S. Pat. No. 4,923,788; UV-absorbing agents: compounds (18b) to (18r) of formula (I), and 101 to 427 on pages 6 to 9, of JP-A No. 3335/1971, compounds (3) to (66) (of formula (I)) on pages 10 to 44, and compounds HBT-1 to -10 (of formula (III)) on page 14, of European Patent No. 520,938A, and compounds (1) to (31) (of formula (1)) in columns 2 to 9 of European Patent No. 521,823A.

Suitable supports for use in the present invention are described, for example, in the above-mentioned *Research Disclosure* No. 17643, page 28, ibid. No. 18716, from page 647, right column to page 648, left column, and ibid. No. 307105, page 879.

In the light-sensitive material of the present invention, preferably the total film thickness of all the hydrophilic colloid layers on the side having emulsion layers is 28 μm or below, more preferably 23 μm or below, further more preferably 18 μm or below, and particularly preferably 16 μm or below. Preferably the film swelling speed $T_{1/2}$ is 30 sec or below, more preferably 20 sec or below. $T_{1/2}$ is defined as the time required to reach a film thickness of ½ of the saturated film thickness that is 90% of the maximum swelled film thickness that will be reached when the film is processed with a color developer at 30° C. for 3 min 15 sec. The term "film thickness" means film thickness measured after moisture conditioning at 25° C. and a relative humidity of 55% for two days, and the film swelling speed $T_{1/2}$ can be measured by using a swellometer (swell-measuring meter) of the type described by A. Green et al. in *Photographic Science and Engineering*, Vol. 19, No. 2, pp. 124–129. The film swelling speed $T_{1/2}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness—film thickness)/Film thickness.

It is preferable that the light-sensitive material of the present invention is provided a hydrophilic colloid layer (designated as a backing layer) having a total dried film thickness of 2 μm to 20 μm at the opposite side of the support relative to emulsion layers. In such the backing layer, it is preferable to be contained the above-mentioned light-absorbent, filter-dye, UV-absorbent, static preventer, film-hardening agent, binder, plasticizer, lubricant, coating auxiliary, and surface-active agent. The swelling ratio of backing layer is preferably 150 to 500%.

The light-sensitive material of the present invention can be subjected to the development processing by a usual method as described in the above-mentioned RD No. 17643, pp. 28–29, ibid. No. 18716, p. 651, from left column to right column, and ibid. No. 307105, pp. 880–881.

Preferably, the color developer used for the development processing of the light-sensitive material of the present invention is an aqueous alkaline solution whose major component is an aromatic primary amine-series color-developing agent. As the color-developing agent, aminophenol-series compounds are useful, and p-phenylenediamine-series compounds are preferably used, and typical or preferable examples thereof include compounds described in lines 43 to 52 on page 28 of EP Patent No. 556700A. A combination of two or more of these compounds may be used in accordance with the purpose.

The color developer generally contains, for example, pH buffers, such as carbonates, borates or phosphates of alkali metals, and development inhibitors or antifoggants, such as chloride salt, bromide salts, iodide salts, benzimidazoles, benzothiazoles, or mercapto compounds. The color developer may, if necessary, contain various preservatives, such as hydroxylamine, diethylhydroxylamine, sulfites, hydrazines (e.g. N,N-bis-carboxymethylhydrazine), phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developing agents such as 1-phenyl-3-pyrazolidone, tackifiers, and various chelate agents as represented by aminopolycarboxylic acids, aminopolysulfonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylene-diamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination. Generally the pH of these color developer and black-and-white developing solution is 9 to 12. The replenishing amount of these developing solutions is generally 3 liter or below per square meter of the light-sensitive material to be processed, though the replenishing amount changes depending on the type of color photographic light-sensitive material. If the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with air.

The contact area of the photographic processing solution with the air in the processing tank (processing effects in contact) is evaluated with the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

The opened surface ratio is preferably 0.1 $\text{cm}^{-1}$ or less, more preferably 0.001 to 0.05$\text{cm}^{-1}$. Methods for reducing the opened surface ratio that can be mentioned include a utilization of movable lids, as described in JP-A No. 82033/1989, and a slit-developing process as described in JP-A No. 216050/1988, besides a method of providing a shutting material such as a floating lid on the surface of a photographic processing solution in a processing tank. It is preferable to adopt the means for reducing the opened surface ratio not only in a color developing process and a black-and-white developing process but also in all the succeeding processes, such as bleaching, bleach-fixing, fixing, washing with water, and stabilizing processes. It is also possible to reduce the replenishing amount by using a means of suppressing the accumulation of bromide ions in the developer.

The processing time of color developing is settled, in generally, between 2 and 5 minutes, and the time can be shortened by, for example, processing at high temperature and at high pH, and using a color developer having high concentration of color developing agent.

The photographic emulsion layer are generally subjected to a bleaching process after color development.

The beaching process can be carried out together with the fixing process (bleach-fixing process), or it can be carried out separately from the fixing process. Further, to quicken the process, the bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process. As the bleaching agent, use can be made of, for example, compounds of polyvalent metals, such as iron (III), peracids, quinones, nitro compounds. As the typical bleaching agent, use can be made of organic complex salts of iron (III), such as complex salts of aminopolycarboxylic acids, for example ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts and 1,3-diaminopropanetetraacetic acid iron (III) complex salt are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0. If it is required to quicken the process, the process can be effected at a lower pH.

In the bleaching solution, the bleach-fixing solution, and the bath preceding them, a bleach-accelerating agent may be used if necessary. Specific examples of useful bleach-accelerating agents are compounds having a mercapto group or a disulfide linkage, described in U.S. Pat. No. 3,893,858, German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/1978, and 28426/1978, and *Research Disclosure* No. 17129 (July, 1978); thiazolidine derivatives, described in JP-A No. 140129/1975; thiourea derivatives, described in JP-B No. 8506/1970, JP-A Nos. 20832/1977 and 32735/1978, and U.A. Patent No. 3,706,561; iodide salts, described in German Patent No. 1,127,715 and JP-A No. 16235/1983; polyoxyethylene compounds described in German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.A. Patent No. 3,893,858, German Patent No. 1,290,812, and JP-A No. 95630/1978 are preferable. Further, compound described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, preferably the bleaching solution and the bleach-fixing solution contain an organic acid in order to prevent bleach stain. Particularly preferable organic acids are compounds having an acid dissociation constant (pKa) of 2 to 5 and specifically, for example, acetic acid, propionic acid, and hydroxyacetic acid are preferable.

As the fixing agent used in the fixing solution and the bleach-fixing solution, for example, thiosulfates, thiocyanates, thioether-series compounds, thioureas, and large amount of iodide salts can be mentioned, thiosulfates are generally used, and particularly ammonium thiosulfate can be most widely used. A combination of a thiosulfate with a thiocyanate, a thioether-series compound, a thiourea, or the like is also preferably used. As the preservative of the fixing solution and the bleach-fixing solution, a sulfite, a bisulfite, a carbonyl-bisulfinic acid adduct, or a sulfinic acid compound described in European Patent No. 294769A is preferable. Further, to the fixing solution and the bleach-fixing solution, various aminopolycarboxylic acids and organic phosphonic acids are preferably added in order to stabilize the solution.

In the present invention, to the fixing solution or the bleach-fixing solution is added preferably a compound having a pKa of 6.0 to 9.0 in order to adjust the pH and preferably imidazoles, such as imidazole, 1-methylimidazole, 1-ethylimidazole, and 2-methylimidazole, are added in an amount of 0.1 to 10 mol/liter.

With respect to the total time of the desilvering step, the shorter the total time is within the range wherein silver retention does not occur, the more referable it is. Preferably, it is 1 to 3 min, more referably 1 to 2 min. Further, the processing temperature is generally 25 to 50° C., preferably 35 to 45° C. In a preferable temperature range, the desilvering speed can be improved and stain can be prevented effectively from occurring after the processing.

In the desilvering step, the stirring is preferably intensified as far as possible. Specific means of intensifying the stirring include a method described in JP-A No. 183460/1987 wherein a jet of a processing solution is struck against the emulsion surface of a photographic material, a method described in JP-A No. 183461/1987 wherein the stirring effect is increased by using a rotating means, a method wherein a photographic material is moved with the emulsion surface in contact with a wiper blade placed in a solution so that the emulsion surface is made turbulent to improve the stirring effect, and a method wherein the circulated amount of the whole of a processing solution is increased. Such a stirring improving means is effective for any of the bleaching solution, the bleach-fixing solution, and the fixing solution. It appears that the improvement in stirring quickens the supply of the bleaching agent and the fixing agent into the emulsion coating and as a result the desilvering speed is increased. The above stirring improving means is effective when a bleach accelerator is used, and the acceleration effect can be increased remarkably or the fixing hindering effect by the bleach accelerator can be removed.

The automatic processor used in processing the photographic material of the present invention has preferably a photographic material carrying means, described in JP-A Nos. 191257/1985, 191258/1985, and 191259/1985. As described in the above JP-A No. 191257/1985, such a conveying means can reduce remarkably the carry-in of the processing solution to a bath from the preceding bath, and therefore is high in the effect in preventing the performance of the processing solution from being deteriorated. Such an effect is particularly effective in shortening the processing time in each step and in reducing the replenishing amount of the processing solution.

It is common for the photographic material of the present invention to undergo, after a desilvering process such as fixing or bleach-fixing, a washing step and/or a stabilizing step. The amount of washing water may be set within a wide range depending on the characteristics of the photographic material (e.g., due to the materials used, such as couplers), the application of the photographic material, the washing temperature, the number of washing tanks (the number of steps), the type of replenishing system, including, for example, the counter-current system and the direct flow system, and other various conditions. Of these, the relationship between the number of water-washing tanks and the amount of washing water in the multi-stage counter current system can be found according to the method described in *Journal of the Society of Motion Picture and Television Engineers*, Vol. 64, pages 248 to 253 (May 1955). According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the color photographic material of the present invention, as a measure to solve this problem the method of reducing calcium ion and magnesium ion described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku*, (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in processing the photographic material of the present invention is generally 4 to 9, preferably 5 to 8. The washing water temperature and the washing time to be set may vary depending, for example, on the characteristics and the application of the photographic material, and they are generally selected in the range of 15 to 45° C. for 20 sec to 10 min, and preferably in the range of 25 to 40° C. for 30 sec to 5 min. Further, the photographic material of the present invention can be processed directly with a stabilizing solution instead of the above washing. In such a stabilizing process, any of known processes, described in JP-A Nos. 8543/1982, 14834/1983, and 220345/1985 can be applied.

In some cases, the above washing process is further followed by a stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehydes (e.g., formalin and gultalaldehyde), N-methylol compounds, hexamethylene-tetramine and aldehyde-sulfite adducts. In this stabilizing bath, each kind of the chelating agents and bactericides may be added.

The over-flowed solution due to the replenishing of washing water and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic light-sensitive material of the present invention may contain therein (built-in) a color-developing agent for the purpose of simplifying and quickening the process. To built-in such a color-developing agent, it is preferable to use various precursors for color-developing agents. For example, indoaniline-series compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-series compounds described in JP-A No. 135628/1978 can be mentioned.

For the purpose of accelerating the color development, the light-sensitive material of the present invention may be built in, if necessary, various 1-phenyl-3-pyrazolicones. Typical compounds are described in JP-A Nos. 64339/1981, 144547/1982, and 115438/1983.

The various processing solutions used for the processing of the light-sensitive material of the present invention may be used generally at 10 to 50° C. Although generally a temperature of 33 to 38° C. may be standard, a higher temperature can be used to accelerate the process to reduce the processing time, or a lower temperature can be used to improve the image quality or the stability of the processing solution.

The present invention can be preferably applied to a silver halide photographic light-sensitive material having a transparent magnetic recording layer. A silver halide light-sensitive material having such a magnetic recording layer coated on a support, for use in the present invention, can be prepared by a method in which ferromagnetic particles described in JP-A Nos. 23505/1984, 195726/1992, and 59357/1994 are coated on the following support. Preferably, the support for use in the present invention is a support produced by a method in which a pre-heat-treated thin-layer polyester support, as described in detail in JP-A Nos. 35118/1994 and 17528/1994, and KOKAIGIHO 94-6023 (HATSUMEI KYOKAI), an example of which is a polyethylene-aromatic dicarboxylate-series polyester support of generally from 50 μm to 300 μm, preferably from 50 μm to 200 μm, more preferably from 80 to 115 μm, and particularly preferably from 85 μm to 105 μm thickness, is subjected to heat treatment (annealing), at a temperature of from 40° C. to the glass transition temperature, for 1 to 1500 hours, and then such an annealed support is further subjected to a surface treatment, such as ultraviolet ray irradiation, as described in JP-B Nos. 2603/1968, 2604/1968, and 3828/1970, corona discharge, as described in JP-B No. 5043/1973 and JP-A No. 131576/1976, and glow discharge, as described in JP-B Nos. 7578/1960 and 43480/1971, followed by a coating of a subbing layer, as described in U.S. Pat. No. 5,326,689, and if necessary a coating of an underlayer, as described in U.S. Pat. No. 2,761,791.

The above-mentioned magnetic layer may be a striped form, as described in JP-A Nos. 124642/1992 and 124645/1992.

Further, if necessary, the above-described support is subjected to an antistatic treatment as described in JP-A No. 62543/1992, and finally at least one silver halide emulsion is coated thereon. Examples of the above-described silver halide emulsion to be used are those described in JP-A Nos. 166932/1992, 41436/1991, and 41437/1991.

Preferably, the thus-produced light-sensitive material is manufactured according to the method of production management described in JP-B No. 86817/1992, and production data are recorded according to the method described in JP-B No. 87146/1994. After that, or before that, in accordance with the method described in JP-A No. 125560/1992, the material is cut into a film whose width is narrower than the conventional 135 size, and for the perforation, two holes are made at one side of the film, per picture of small format, so that the perforation goes well with a picture of smaller format than the conventional one.

The thus-manufactured film can be encased to be used in a cartridge (magazine) package described in JP-A No. 157459/1992, a cartridge illustrated in FIG. 9 shown in Example of JP-A No. 210202/1993, a film patrone described in U.S. Pat. No. 4,221,479, or a cartridge described in U.S. Pat. Nos. 4,834,306, 4,834,366, 5,226,613, and 4,846,418.

Preferred of these film cartridges and film patrones for use in the present invention, from the viewpoint of light shielding, are those in which the tongue is contained (encased), as described in U.S. Pat. Nos. 4,848,693, and 5,317,355.

Further, a cartridge having a lock machinery, as described in U.S. Pat. No. 5,296,886; a cartridge in which the state of use of a film is indicated, as described in U.S. Pat. No. 5,347,334; and a cartridge having a double exposure-preventing function, are preferred.

Further, use can be made of a cartridge in which a film is easily encased by simply inserting the film in the cartridge, as described in JP-A No. 85128/1994.

The thus-produced film cartridge can be used according to the purpose for photographing, development processing, and various kinds of pleasure (enjoyment) of photography, by means of cameras, a developing apparatus, or other Labo machines, as described below.

The function of a film cartridge (patrone) can be fully demonstrated by cameras that are exemplified by a simple loading-type camera, as described in JP-A Nos. 8886/1994 and 99908/1994; an auto winding-type camera, as described in JP-A Nos. 57398/1994 and 101135/1994; a camera from which a film can be taken out to exchange the film in the middle of photographing, as described in JP-A No. 205690/1994; a camera capable of recording, on a magnetic recording layer of the film, such information, at the time of photographing, as panorama photographing, high-vision photographing, and ordinary photographing (capable of recording magnetic information by which the print aspect ratio can be selected), as described in JP-A Nos. 293138/1994 and 283382/1993; a camera having a double exposure-preventing function, as described in JP-A No. 101194/1994; and a camera having a function by which the state of use of a film and the like can be displayed, as described in JP-A No. 150577/1993.

The thus-photographed films may be processed by an auto processor, as described in JP-A Nos. 222514/1994 and 222545/1994. Alternatively, before, or in the middle of, or after the processing of the film, a method of taking advantage of a magnetic recording on the film, as described in JP-A Nos. 95265/1994 and 123054/1992, may be used. The function by which the aspect ratio can be selected, as described in JP-A No. 19364/1993, may be used.

For the Cine-type development, the photographed film is spliced to process according to a method described in JP-A No. 119461/1993 when developed.

Further, at the time of development processing, or after that, an attach and detach processing, as described in JP-A No. 148805/1994, can be used.

After the above-described processing has finished, according to the methods described in JP-A Nos. 184835/1990, 186335/1992, and 79968/1994, a back print and a front print may be performed on a color paper, and after that, film information may be converted to the print.

Further, an index print, as described in JP-A Nos. 11353/1993 and 232594/1993, with the used cartridge, may be returned to a customer.

According to the present invention, a silver halide photographic light-sensitive material that suppresses the occurrence of a fog, and that has a high-quality image and a high sensitivity, can be provided.

EXAMPLES

The present invention is explained in more detail below by reference to examples, but the present invention is not limited to these examples shown.

Example 1

(1) Preparation of emulsion 6 g of potassium bromide and 30 g of inactive gelatin, whose average molecular weight was 15,000, were dissolved in 3.7 liter of distilled water, to make an aqueous solution. To the well-stirred aqueous solution, a 14% aqueous solution of potassium bromide and a 20% aqueous solution of silver nitrate were added, at a constant current amount, at 55° C. and a pBr of 1.0 for one minute, according to a double jet process. By the addition of these, 2.4% of the total silver amount was consumed.

An aqueous gelatin solution (17%, 300 ml) was added to the emulsion, and then it was stirred at 55° C. After that, a 20% aqueous solution of silver nitrate was added to the emulsion, at a constant current amount, until the value of pBr increased up to 1.4. By this addition, 5.0% of the total silver amount was consumed. After that, $1.2\times10^{-5}$ mol of thiourea dioxide, per mole of silver, was added to the emulsion, and further a 20% aqueous solution of potassium iodobromide ($KBr_{1-X}I_X$: X=0.04) and a 33% aqueous solution of silver nitrate were added to the emulsion over 43 minutes, according to a double jet process. By this addition, 50% of the total silver amount was consumed. After the addition of $2.5\times10^{-4}$ mol of sodium ethylthiosulfonate, per mol of silver, an aqueous solution containing 8.3 g of potassium iodide was added, followed by 14.5 ml of a 0.001 wt % aqueous solution of $K_3IrCl_6$. Further, a 20% aqueous solution of potassium bromide and a 33% aqueous solution of silver nitrate were added to the emulsion over 39 minutes, according to a.double jet process. By this addition, 42.6% of the total silver amount was consumed. The total amount of silver nitrate that was used for this emulsion was 425 g. After desalting according to a usual flocculation method, the emulsion was adjusted to pAg 8.2 and pH 5.8, at 40° C. By this method, a tabular silver iodobromide emulsion (Em-1) having an average aspect ratio of 6.5, a deviation coefficient of grain size distribution of 18%, and a grain diameter, that was equivalent to a diameter of a sphere which a grain was assumed to be, of 0.8 $\mu$m, was prepared. At least 50 (average) dislocation lines per grain, which lines existed at the vicinity of the perimeter of the tabular grains, were observed by means of a transmission-type electron microscope of 200 kV, at the temperature of liquid nitrogen ($N_2$).

The sensitizing dyes shown in Table 2 were added to the thus-prepared emulsion Em-1, in the amounts shown in Table 2, respectively. After that, these emulsions were optimumly subjected to a gold-selenium-sulfur sensitization using sodium thiosulfate, chloroauric acid, N,N-dimethylselenourea, and potassium thiocyanate, to prepare Emulsions 151 to 171. Further, the sensitizing dyes shown in Table 1 were added to a tabular silver iodobromide emulsion (Em-2) that was prepared in the same manner as the above-mentioned emulsion recipe, except that the steps of adding thiourea dioxide and sodium ethylthiosulfonate were omitted, whereby Emulsions 101 to 121 were prepared.

A photographic emulsion layer and a protective layer were coated on a triacetylcellulose support on which a subbing layer had been coated, in the coating amounts shown in the following table, and thereby Samples 1001 to 1021 and 1051 to 1071 were prepared.

TABLE 1

Prepared Emulsions

| Emulsion No. | Sensitizing dye | Remarks (no reduction) |
|---|---|---|
| 101 | SD-1 ($4.6 \times 10^{-4}$ mol/mol Ag) | Comparative example |
| 102 | III-33 ($4.6 \times 10^{-4}$ mol/mol Ag) | " |
| 103 | III-34 ($4.6 \times 10^{-4}$ mol/mol Ag) | " |
| 104 | SD-2 ($4.6 \times 10^{-4}$ mol/mol Ag) | " |
| 105 | III-1 ($4.6 \times 10^{-4}$ mol/mol Ag) | " |
| 106 | III-8 ($4.6 \times 10^{-4}$ mol/mol Ag) | " |
| 107 | III-3 ($4.6 \times 10^{-4}$ mol/mol Ag) | " |
| 108 | III-5 ($4.6 \times 10^{-4}$ mol/mol Ag) | " |
| 109 | SD-3 ($4.6 \times 10^{-4}$ mol/mol Ag) | " |
| 110 | III-15 ($4.6 \times 10^{-4}$ mol/mol Ag) | " |
| 111 | SD-4 ($4.6 \times 10^{-4}$ mol/mol Ag) | " |
| 112 | III-21 ($4.6 \times 10^{-4}$ mol/mol Ag) | " |
| 113 | SD-2 ($3.2 \times 10^{-4}$ mol/mol Ag) + SD-3 ($9.2 \times 10^{-5}$ mol/mol Ag) + SD-4 ($4.6 \times 10^{-5}$ mol/mol Ag) | " |
| 114 | III-5 ($3.2 \times 10^{-4}$ mol/mol Ag) + III-15 ($9.2 \times 10^{-5}$ mol/mol Ag) + III-21 ($4.6 \times 10^{-5}$ mol/mol Ag) | " |
| 115 | SD-5 ($4.6 \times 10^{-4}$ mol/mol Ag) | " |
| 116 | III-23 ($4.6 \times 10^{-4}$ mol/mol Ag) | " |
| 117 | III-24 ($4.6 \times 10^{-4}$ mol/mol Ag) | " |
| 118 | SD-6 ($4.4 \times 10^{-4}$ mol/mol Ag) + SD-7 ($2.0 \times 10^{-5}$ mol/mol Ag) | " |
| 119 | III-28 ($4.4 \times 10^{-4}$ mol/mol Ag) + III-29 ($2.0 \times 10^{-5}$ mol/mol Ag) | " |
| 120 | SD-5 ($1.8 \times 10^{-4}$ mol/mol Ag) + SD-6 ($2.6 \times 10^{-4}$ mol/mol Ag) + SD-7 ($2.0 \times 10^{-5}$ mol/mol Ag) | " |
| 121 | III-24 ($1.8 \times 10^{-4}$ mol/mol Ag) + III-28 ($2.6 \times 10^{-4}$ mol/mol Ag) + III-29 ($2.0 \times 10^{-5}$ mol/mol Ag) | " |

TABLE 2

Prepared Emulsions

| Emulsion No. | Sensitizing dye | Remarks (no reduction) |
|---|---|---|
| 151 | SD-1 ($4.6 \times 10^{-4}$ mol/mol Ag) | Comparative example |
| 152 | III-33 ($4.6 \times 10^{-4}$ mol/mol Ag) | This invention |
| 153 | III-34 ($4.6 \times 10^{-4}$ mol/mol Ag) | This invention |
| 154 | SD-2 ($4.6 \times 10^{-4}$ mol/mol Ag) | Comparative example |
| 155 | III-1 ($4.6 \times 10^{-4}$ mol/mol Ag) | This invention |
| 156 | III-8 ($4.6 \times 10^{-4}$ mol/mol Ag) | This invention |
| 157 | III-3 ($4.6 \times 10^{-4}$ mol/mol Ag) | This invention |
| 158 | III-5 ($4.6 \times 10^{-4}$ mol/mol Ag) | This invention |
| 159 | SD-3 ($4.6 \times 10^{-4}$ mol/mol Ag) | Comparative example |
| 160 | III-15 ($4.6 \times 10^{-4}$ mol/mol Ag) | This invention |
| 161 | SD-4 ($4.6 \times 10^{-4}$ mol/mol Ag) | Comparative example |
| 162 | III-21 ($4.6 \times 10^{-4}$ mol/mol Ag) | This invention |
| 163 | SD-2 ($3.2 \times 10^{-4}$ mol/mol Ag) + SD-3 ($9.2 \times 10^{-5}$ mol/mol Ag) + SD-4 ($4.6 \times 10^{-5}$ mol/mol Ag) | Comparative example |
| 164 | III-5 ($3.2 \times 10^{-4}$ mol/mol Ag) + III-15 ($9.2 \times 10^{-5}$ mol/mol Ag) + III-21 ($4.6 \times 10^{-5}$ mol/mol Ag) | This invention |
| 165 | SD-5 ($4.6 \times 10^{-4}$ mol/mol Ag) | Comparative example |
| 166 | III-23 ($4.6 \times 10^{-4}$ mol/mol Ag) | This invention |
| 167 | III-24 ($4.6 \times 10^{-4}$ mol/mol Ag) | This invention |
| 168 | SD-6 ($4.4 \times 10^{-4}$ mol/mol Ag) + SD-7 ($2.0 \times 10^{-5}$ mol/mol Ag) | Comparative example |
| 169 | III-28 ($4.4 \times 10^{-4}$ mol/mol Ag) + III-29 ($2.0 \times 10^{-5}$ mol/mol Ag) | This invention |
| 170 | SD-5 ($1.8 \times 10^{-4}$ mol/mol Ag) + SD-6 ($2.6 \times 10^{-4}$ mol/mol Ag) + SD-7 ($2.0 \times 10^{-5}$ mol/mol Ag) | Comparative example |
| 171 | III-24 ($1.8 \times 10^{-4}$ mol/mol Ag) + III-28 ($2.6 \times 10^{-4}$ mol/mol Ag) + III-29 ($2.0 \times 10^{-5}$ mol/mol Ag) | This invention |

Emulsion coating condition (1) Emulsion layer

○ Emulsion --- Emulsion 101 to 125, 151/175 (Silver $2.1 \times 10^{-2}$ mol/m$^2$)
○ Coupler ($1.5 \times 10^{-3}$ mol/m$^2$)

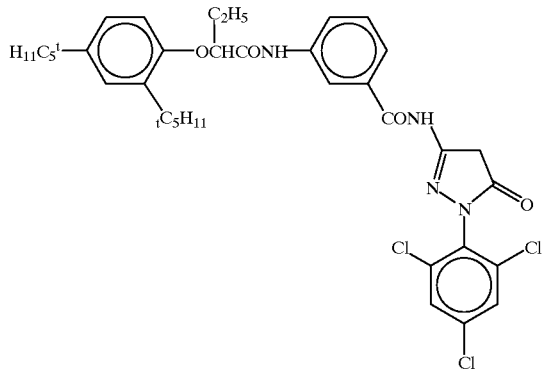

○ Tricresyl phosphate (1.10 g/m$^2$)
○ Gelatin (2.30 g/m$^2$)

(2) Protective layer

○ 2,4-dichlorotriazine-6-hydroxy-s-triazine sodium salt (0.08 g/m$^2$)
○ Gelatin (1.80 g/m$^2$)

SD-1

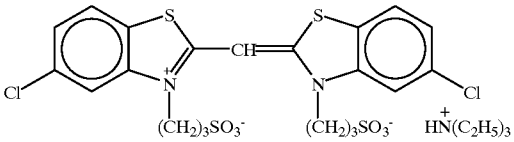

SD-2

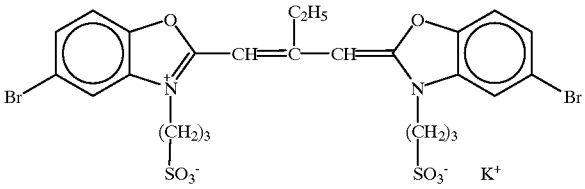

SD-3

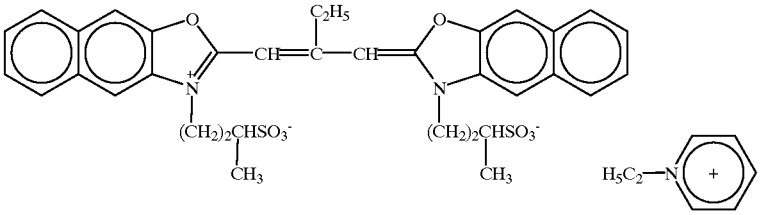

SD-4

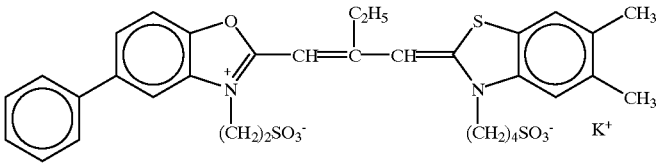

SD-5

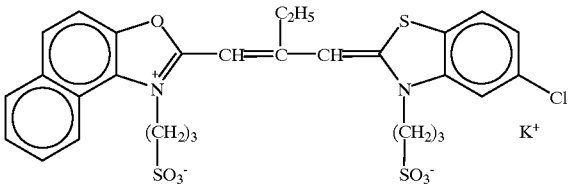

SD-6

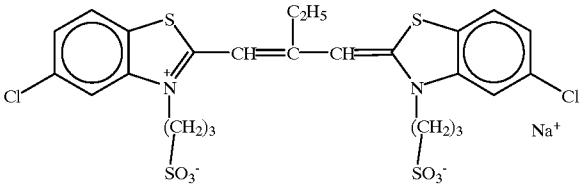

SD-7

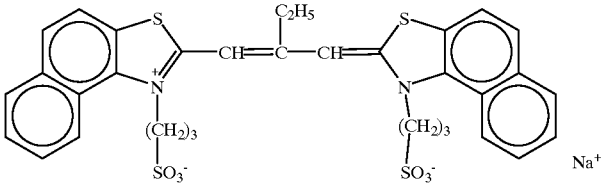

These samples were exposed to light for sensitometry for 1/100 second through a continuous wedge and a gelatin filter SC-39 (manufactured by Fuji Photo Film Co., Ltd.), for samples 1001 to 1003 and 1051 to 1053, or a gelatin filter SC-50 (manufactured by Fuji Photo Film Co., Ltd.), for samples 1004 to 1021 and 1054 to 1071, at a color temperature of 4800° K., followed by color development processing as described below. The development processing herein used was carried out at 38° C. at the following conditions.

Processing for Color Development

| Processing Steps | Processing Time | Processing Temperature | Reple-nisher | Tank volume |
|---|---|---|---|---|
| Color Development | 2 min 45 sec | 38° C. | 33 ml | 20 liter |
| Bleaching | 6 min 30 sec | 38° C. | 25 ml | 40 liter |
| Washing | 2 min 10 sec | 24° C. | 1200 ml | 20 liter |
| Fixing | 4 min 20 sec | 38° C. | 25 ml | 30 liter |
| Washing (1) | 1 min 05 sec | 24° C. | * | 10 liter |
| Washing (2) | 1 min 00 sec | 24° C. | 1200 ml | 10 liter |
| Stabilization | 1 min 05 sec | 38° C. | 25 ml | 10 liter |
| Drying | 4 min 20 sec | 55° C. | | |

Note:
*Counter current piping system from (2) to (1)
Replenishing amount per 35 mm in width per meter in length.

The compositions of the processing solutions are described below.

| | Mother solution (g) | Replenisher (g) |
|---|---|---|
| Color Developer | | |
| Diethylenetriamine-pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate salt | 2.4 | 2.8 |
| 4-[N-ethyl-N-β-Hydroxyethylamino]-2-methylaniline sulfate salt | 4.5 | 5.5 |
| Water to make | 1.0 liter | 1.0 liter |
| pH | 10.05 | 10.10 |
| Bleaching Solution | | |
| Fe (III) sodium ethylenediamineteraacetate trihydrate | 100.0 | 120.0 |
| Disodium ethylenediaminetetraacetate | 10.0 | 11.0 |

-continued

| | Mother solution (g) | Replenisher (g) |
|---|---|---|
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| pH | 6.0 | 5.7 |
| Fixing Solution | | |
| Sodium ethylenediaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 liter | 1.0 liter |
| pH | 6.7 | 6.6 |
| Stabilizer | | |
| Formalin (37%) | 2.0 ml | 3.0 ml |
| Polyoxyethylene-p-monononylphenylether (average polymerization degree: 10) | 0.3 | 0.45 |
| Disodium ethylenediaminetetraacetate | 0.05 | 0.08 |
| Water to make | 1.0 liter | 1.0 liter |
| pH | 5.8–8.0 | 5.8–8.0 |

The measurements of the color density of the processed Samples were conducted.

A relative value of sensitivity corresponding to a reciprocal of an exposure amount at which an optical density of fog+0.2 was obtained, was shown as a fresh sensitivity. Further, unexposed films (Samples), after being stored at the condition of R.H. 60% and 50° C. for 14 days, were subjected to exposure to light and development processing in the same manner as mentioned above. Subsequently, sensitivity and fog were evaluated for the unexposed films in the same manner as described above.

The results thus obtained are shown in Tables 3 and 4. Herein, the relative sensitivity is relatively represented assuming that the sensitivity of Sample No. 1001 is the standard (100).

TABLE 3

| | | Fresh | | After the passage of time (no reduction) | | |
|---|---|---|---|---|---|---|
| Sample No. | Used emulsion | Relative Sensitivity | Fog | Relative Sensitivity | Fog | Remarks |
| 1001 | 101 | 100 (Standard) | 0.21 | 62 | 0.33 | Comparative example |
| 1002 | 102 | 100 | 0.21 | 58 | 0.33 | Comparative example |
| 1003 | 103 | 97 | 0.20 | 62 | 0.33 | Comparative example |
| 1004 | 104 | 126 | 0.22 | 89 | 0.48 | Comparative example |
| 1005 | 105 | 126 | 0.22 | 89 | 0.48 | Comparative example |
| 1006 | 106 | 118 | 0.20 | 82 | 0.45 | Comparative example |
| 1007 | 107 | 122 | 0.22 | 89 | 0.48 | Comparative example |
| 1008 | 108 | 122 | 0.22 | 82 | 0.48 | Comparative example |
| 1009 | 109 | 138 | 0.22 | 107 | 0.46 | Comparative example |
| 1010 | 110 | 133 | 0.22 | 107 | 0.45 | Comparative example |
| 1011 | 111 | 145 | 0.21 | 115 | 0.38 | Comparative example |
| 1012 | 112 | 145 | 0.20 | 110 | 0.37 | Comparative example |
| 1013 | 113 | 162 | 0.22 | 120 | 0.44 | Comparative example |
| 1014 | 114 | 157 | 0.21 | 108 | 0.42 | Comparative example |
| 1015 | 115 | 155 | 0.22 | 102 | 0.39 | Comparative example |
| 1016 | 116 | 155 | 0.22 | 98 | 0.38 | Comparative example |
| 1017 | 117 | 150 | 0.21 | 98 | 0.38 | Comparative example |
| 1018 | 118 | 174 | 0.21 | 120 | 0.37 | Comparative example |
| 1019 | 119 | 174 | 0.21 | 120 | 0.37 | Comparative example |

TABLE 3-continued

| Sample No. | Used emulsion | Fresh Relative Sensitivity | Fresh Fog | After the passage of time (no reduction) Relative Sensitivity | After the passage of time (no reduction) Fog | Remarks |
|---|---|---|---|---|---|---|
| 1020 | 120 | 182 | 0.21 | 151 | 0.38 | Comparative example |
| 1021 | 121 | 172 | 0.20 | 151 | 0.38 | Comparative example |

TABLE 4

| Sample No. | Used emulsion | Fresh Relative Sensitivity | Fresh Fog | After the passage of time Relative Sensitivity | After the passage of time Fog | (Reduction) Remarks |
|---|---|---|---|---|---|---|
| 1051 | 151 | 154 | 0.31 | 111 | 0.61 | Comparative example |
| 1052 | 152 | 191 | 0.22 | 161 | 0.44 | This invention |
| 1053 | 153 | 196 | 0.21 | 180 | 0.33 | This invention |
| 1054 | 154 | 191 | 0.55 | 111 | 1.19 | Comparative example |
| 1055 | 155 | 204 | 0.33 | 171 | 0.70 | This invention |
| 1056 | 156 | 212 | 0.33 | 171 | 0.65 | This invention |
| 1057 | 157 | 212 | 0.31 | 188 | 0.60 | This invention |
| 1058 | 158 | 223 | 0.29 | 188 | 0.51 | This invention |
| 1059 | 159 | 212 | 0.50 | 137 | 0.98 | Comparative example |
| 1060 | 160 | 222 | 0.29 | 190 | 0.49 | This invention |
| 1061 | 161 | 212 | 0.44 | 158 | 0.77 | Comparative example |
| 1062 | 162 | 233 | 0.28 | 211 | 0.41 | This invention |
| 1063 | 163 | 212 | 0.42 | 145 | 0.80 | Comparative example |
| 1064 | 164 | 227 | 0.39 | 190 | 0.44 | This invention |
| 1065 | 165 | 218 | 0.39 | 145 | 0.77 | Comparative example |
| 1066 | 166 | 230 | 0.30 | 190 | 0.45 | This invention |
| 1067 | 167 | 230 | 0.30 | 211 | 0.42 | This invention |
| 1068 | 168 | 230 | 0.44 | 155 | 0.71 | Comparative example |
| 1069 | 169 | 238 | 0.32 | 212 | 0.48 | This invention |
| 1070 | 170 | 242 | 0.30 | 167 | 0.73 | Comparative example |
| 1071 | 171 | 255 | 0.26 | 232 | 0.44 | This invention |

As is apparent from the results shown in Tables 3 and 4, it was found that a dye having a sulfoalkenyl group according to the present invention exhibited such several superior properties as considerably high sensitivity, low fog and excellent storage stability, in a reduction-sensitized photographic emulsion. These effects are explained below in more detail. In an emulsion not yet subjected to reduction sensitization, as shown in Table 3, a dye having a sulfoalkenyl group for use in the present invention demonstrated rather lower sensitivity than did a comparative dye having a sulfoalkyl group, even though there was no difference in storage stability between them. On the other hand, surprisingly, in a reduction-sensitized emulsion as shown in Table 4, a dye having a sulfoalkenyl group for use in the present invention specifically provided high sensitivity, low fog and good storage stability.

Example 2

Layers, each having the compositions shown below, were multi-coated on a cellulose triacetate film base (support) having on it an undercoating, to prepare a multilayer color light-sensitive material (color film). (Compositions of Photosensitive Layers)

Main materials used in each layer are classified as follows:

ExC: Cyan coupler

ExM: Magenta coupler

ExY: Yellow coupler

ExS: Sensitizing dye

UV: Ultraviolet ray absorbent

HBS: High-boiling organic solvent

H: Gelatin hardening agent

Figures corresponding to each component represents the coating amount in terms of $g/m^2$, and for silver halide in terms of silver. With respect to sensitizing dyes, the coating amount is shown in mol per mol of silver halide in the same layer.

| | | |
|---|---|---|
| First Layer (Halation-preventing layer) | | |
| Black colloidal silver | silver | 0.09 |
| Gelatin | | 1.60 |
| ExM-1 | | 0.12 |
| ExF-1 | | $2.0 \times 10^{-3}$ |
| Solid disperse dye ExF-2 | | 0.030 |
| Solid disperse dye ExF-3 | | 0.040 |
| HBS-1 | | 0.15 |
| HBS-2 | | 0.02 |
| Second Layer (Intermediate layer) | | |
| Silver bromoiodide emulsion M | silver | 0.065 |
| ExC-2 | | 0.04 |
| Polyethyl acrylate latex | | 0.20 |
| Gelatin | | 1.04 |

-continued

| | | |
|---|---|---|
| Third Layer (Low sensitivity red-sensitive emulsion layer) | | |
| Silver bromoiodide emulsion A | silver | 0.25 |
| Silver bromoiodide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| Fourth Layer (Medium sensitivity red-sensitive emulsion layer) | | |
| Silver bromoiodide emulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| Fifth Layer (High sensitivity red-sensitive emulsion layer) | | |
| Silver bromoiodide emulsion D | silver | 1.40 |
| Dyes for Emulsion 120 [(SD-5) ($1.6 \times 10^{-4}$) + (SD-6) ($3 \times 10^{-4}$) + (SD-7) ($1.5 \times 10^{-5}$)] or dyes for Emulsion 121 [(III-24) ($1.6 \times 10^{-4}$) + (III-28) ($3 \times 10^{-4}$) + (III-29) ($1.5 \times 10^{-5}$)] were used as shown in Table 6. | | |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| Sixth Layer (Intermediate layer) | | |
| Cpd-1 | | 0.090 |
| Solid disperse dye ExF-4 | | 0.030 |
| HBS-1 | | 0.050 |
| Polyethyl acrylate latex | | 0.15 |
| Gelatin | | 1.10 |
| Seventh Layer (Low sensitivity green-sensitive emulsion layer) | | |
| Silver bromoiodide emulsion E | silver | 0.15 |
| Silver bromoiodide emulsion F | silver | 0.10 |
| Silver bromoiodide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth Layer (Medium sensitivity green-sensitive emulsion layer) | | |
| Silver bromoiodide emulsion H | silver | 0.80 |
| ExS-4 | | $3.2 \times 10^{-4}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |

-continued

| | | |
|---|---|---|
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| Ninth Layer (High sensitivity green-sensitive emulsion layer) | | |
| Silver bromoiodide emulsion I | silver | 1.25 |
| Dyes for Emulsion 113 [(SD-2) ($3.2 \times 10^{-4}$) + (SD-3) ($9.2 \times 10^{-5}$) + (SD-4) ($4.6 \times 10^{-5}$)] or dyes for Emulsion 114 [(III-5) ($3.2 \times 10^{-4}$) + (III-15) ($9.2 \times 10^{-5}$) + (III-21) ($4.6 \times 10^{-5}$)] were used as shown in Table 6. | | |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethyl acrylate latex | | 0.15 |
| Gelatin | | 1.33 |
| Tenth Layer (Yellow filter layer) | | |
| Yellow colloidal silver | silver | 0.015 |
| Cpd-1 | | 0.16 |
| Solid disperse dye ExF-5 | | 0.060 |
| Solid disperse dye EXF-6 | | 0.060 |
| Oil-soluble dye ExF-7 | | 0.010 |
| HBS-1 | | 0.60 |
| Gelatin | | 0.60 |
| Eleventh Layer (Low sensitivity blue-sensitive emulsion layer) | | |
| Silver bromoiodide emulsion J | silver | 0.09 |
| Silver bromoiodide emulsion K | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| Twelfth Layer (High sensitivity blue-sensitive emulsion layer) | | |
| Silver bromoiodide emulsion L | silver | 1.00 |
| A dye for Emulsion 101 [(SD-1) ($4.0 \times 10^{-4}$)] or a dye for Emulsion 103 [(III-34) ($4.0 \times 10^{4}$)] was used as shown in Table 6. | | |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| Thirteenth Layer (First protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| Fourteenth Layer (Second protective layer) | | |
| Silver bromoiodide emulsion M | silver | 0.10 |
| H-1 | | 0.40 |
| B-1 (diameter: 1.7 $\mu$m) | | $5.0 \times 10^{-2}$ |
| B-2 (diameter: 1.7 $\mu$m) | | 0.15 |
| B-3 | | 0.05 |

-continued

| | |
|---|---|
| S-1 | 0.20 |
| Gelatin | 0.70 |

Further, in order to improve preservability, processability, pressure resistance, antimold and antibacterial properties, antistatic property, and coating property, compounds of W-1 to W-3, B-4 to B-6, and F-1 to F-17, and salts of iron, lead, gold, platinum, palladium, iridium, and rhodium were suitably added in each layer.

Details of emulsions used in this Example are shown in Table 5.

TABLE 5

| | Average AgI content (%) | Deviation coefficient concerning AgI content among grains (%) | Average sphere-equivalent grain diameter (μm) | Deviation coefficient concerning grain diameter (%) | Diameter of projected area assumed to be a circle (μm) | Ratio of Diameter/ Thickness |
|---|---|---|---|---|---|---|
| Emulsion | | | | | | |
| A | 1.7 | 10 | 0.46 | 15 | 0.56 | 5.5 |
| B | 3.5 | 7 | 0.57 | 20 | 0.78 | 4.0 |
| C | 8.9 | 18 | 0.66 | 17 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 13 | 0.78 | 4.0 |
| G | 8.8 | 13 | 0.61 | 17 | 0.77 | 4.4 |
| H | 8.8 | 25 | 0.61 | 23 | 0.77 | 4.4 |
| I | 8.9 | 18 | 0.84 | 18 | 1.03 | 3.7 |
| J | 1.7 | 10 | 0.46 | 15 | 0.50 | 4.2 |
| K | 8.8 | 15 | 0.64 | 19 | 0.85 | 5.2 |
| L | 14.0 | 18 | 1.28 | 19 | 1.46 | 3.5 |
| M | 1.0 | — | 0.07 | 15 | — | 1 |

In Table 5, (1) Emulsions D, I to L were subjected to a reduction sensitization using thiourea dioxide and thiosulfonic acid (XX-16), at the preparation of grains, according to the Example described in JP-A No. 191938/1990.

Further, emulsions were prepared in the same way, except for using p-quinone instead of (XX-16).

(2) Emulsions A to L were subjected to a gold sensitization, a sulfur sensitization and a selenium sensitization in the presence of respective spectral sensitizing dyes, described in each photosensitive layer, and sodium thiocyanate, according to Example described in JP-A No. 237450/1991.

(3) At the preparation of tabular grains, low-molecular-weight gelatin was used according to Example described in JP-A No. 158426/1989.

(4) Dislocation lines as described in JP-A No. 237450/1991 were observed in the tabular grains under a high-voltage electron microscope.

(5) Emulsion L contained double-structure grains, which grain had a core high in iodide content, as described in JP-A No. 143331/1985.

Preparation of a dispersion of an organic solid disperse dye

ExF-2 as described below was dispersed according to the following method. That is, water (21.7 ml), a 5% aqueous solution of sodium p-octylphenoxyethoxy-ethanesulfonate (3 ml), and a 5% aqueous solution of p-octylphenoxypolyoxyethylene ether (polymerization degree 10) (0.5 g) were added to a pot mill (700 ml), and Dye ExF-2 (5.0 g) and zirconium oxide beads (diameter 1 mm) (500 ml) were further added thereto, and then the mixture was dispersed for 2 hours. For the dispersion, a BO-type vibration ball mill, manufactured by Chuo Koki Co., Ltd., was employed. After the dispersion, the mixture was taken out and added to 8 g of a 12.5% aqueous gelatin solution, and then the beads were removed by filtration, to obtain a gelatin dispersion of the dye. The average grain size of the dye in the form of fine grains was 0.44 μm.

In the similar manner, solid dispersions of ExF-3, ExF-4, and ExF-6 were obtained. The average grain size of these dyes in the form of fine grains was 0.24 μm, 0.45 μm, and 0.52 μm, respectively. On the other hand, ExF-5 was dispersed according to the dispersion method comprising microprecipitation, as described in Example 1 of European Patent No. 549,489A. The average grain size of the dye was 0.06 μm.

ExC-1

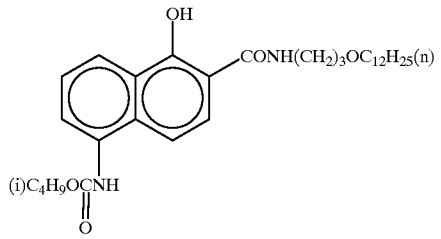

-continued
ExC-2
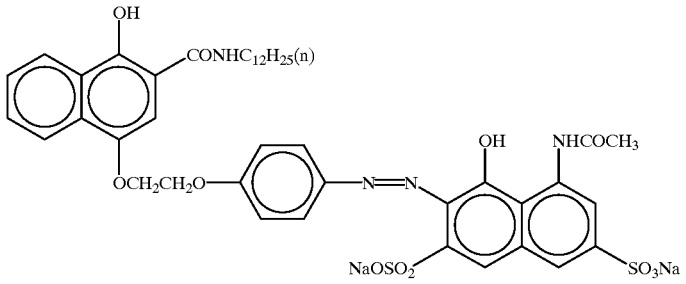
ExC-3
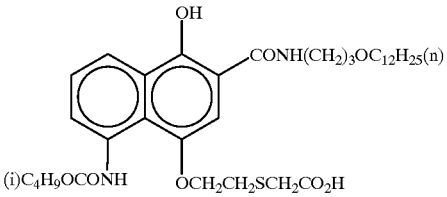
ExC-4
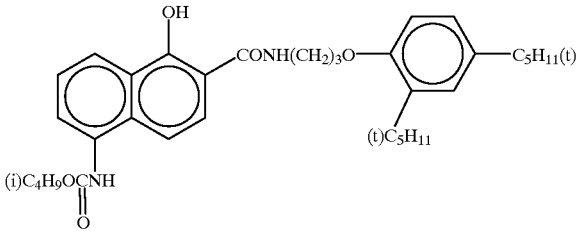
ExC-5
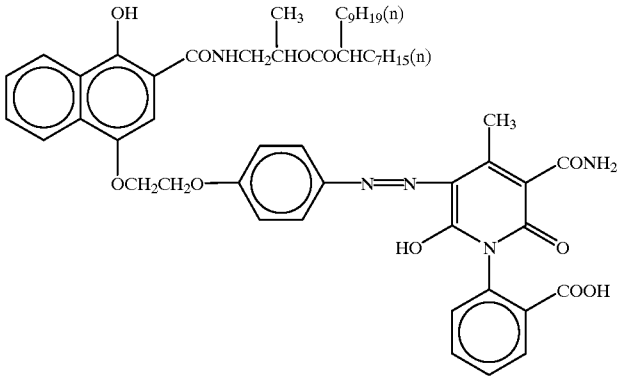
ExC-6
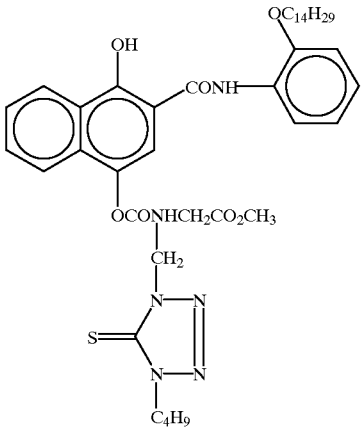

-continued
ExC-7
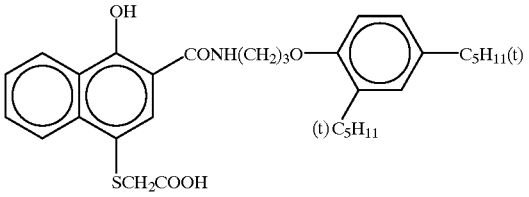
ExC-8
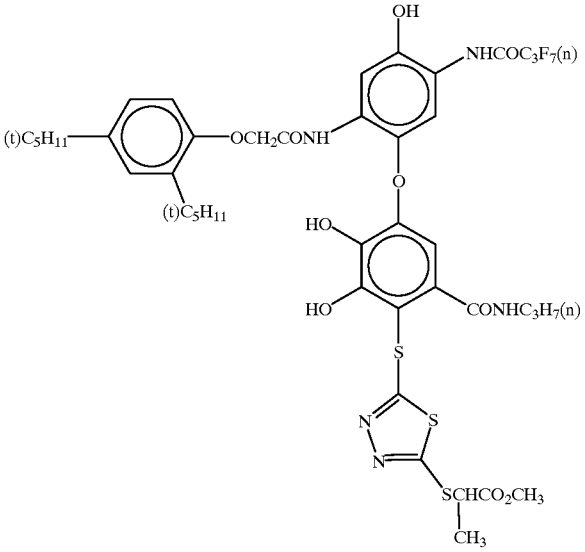
ExM-1
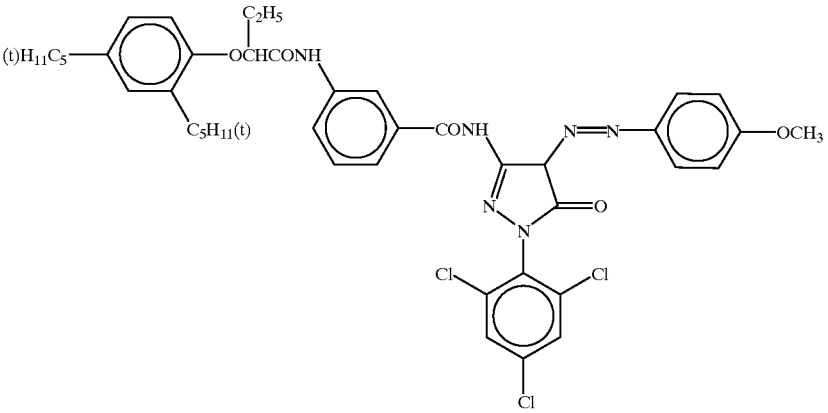

-continued
ExM-2
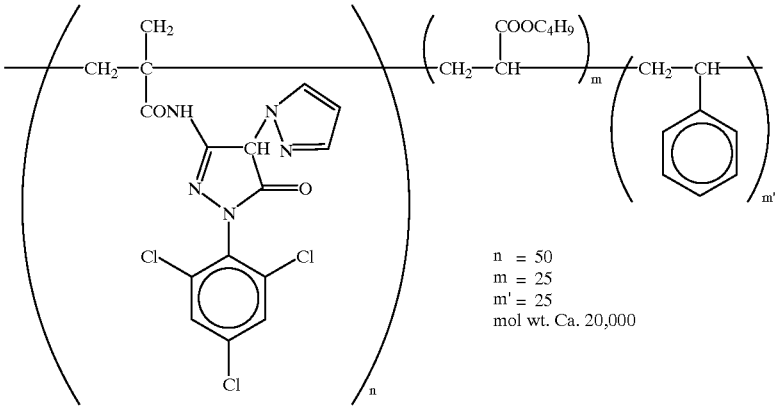
ExM-3
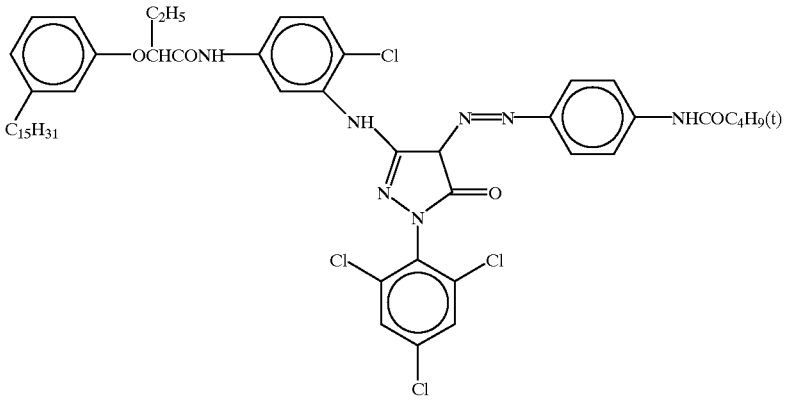
ExM-4
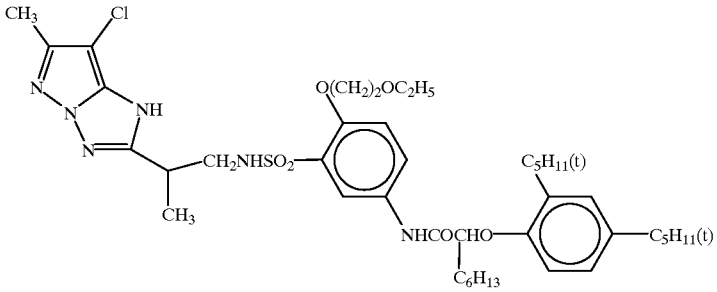
ExM-5
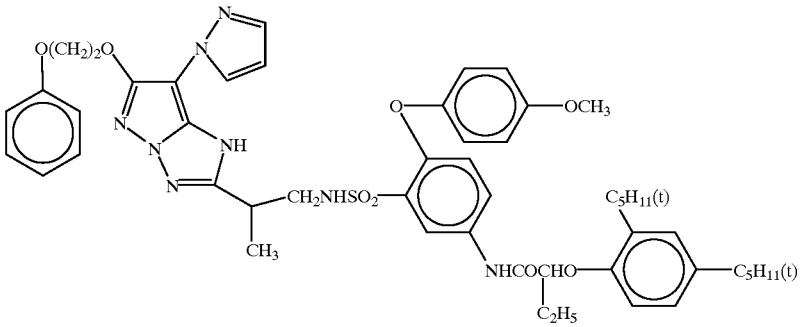

-continued
ExY-1
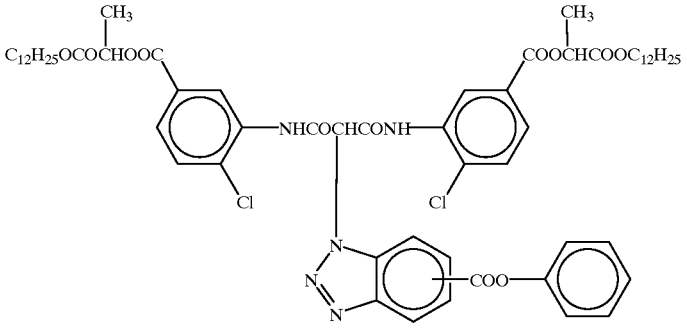
ExY-2
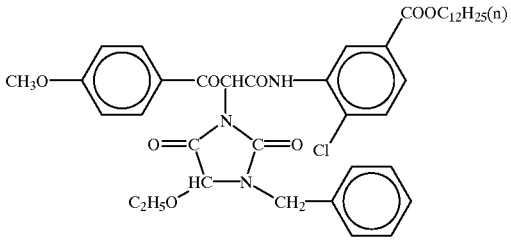
ExY-3
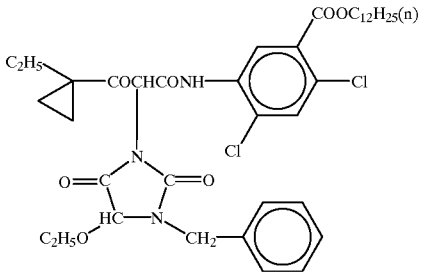
ExY-4
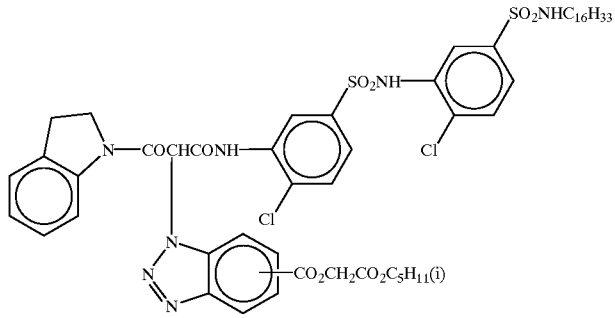
ExY-5
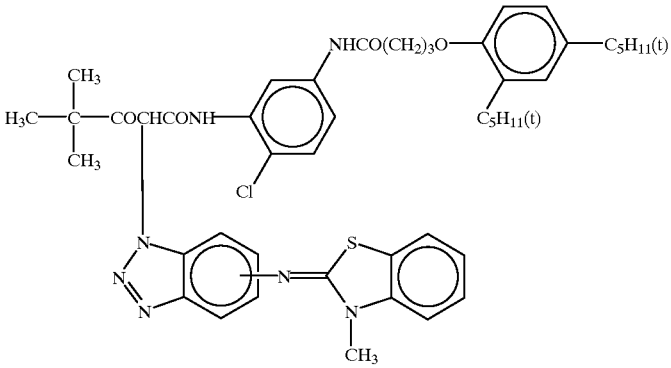

-continued
ExF-1
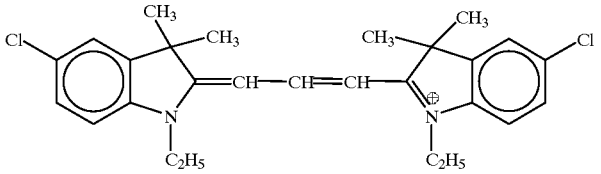
ExF-2
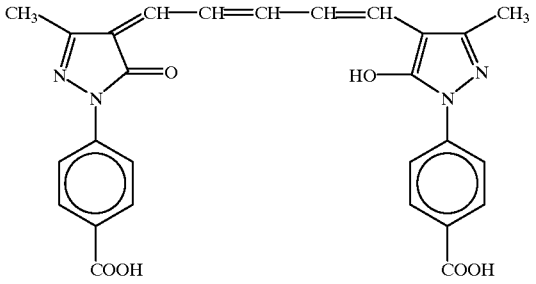
ExF-3
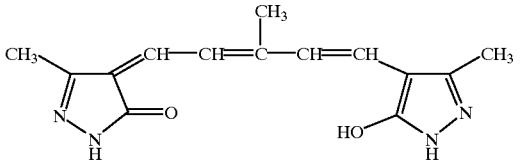
ExF-4
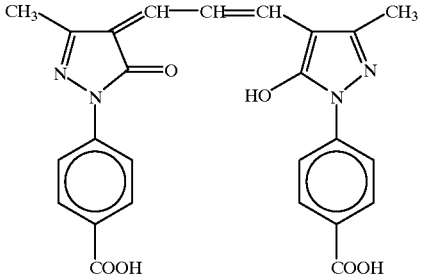
ExF-5
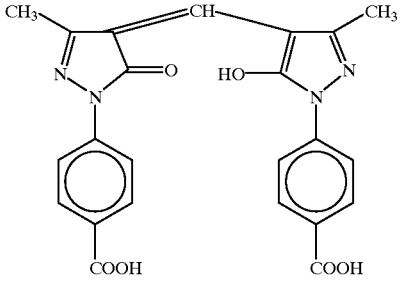
ExF-6
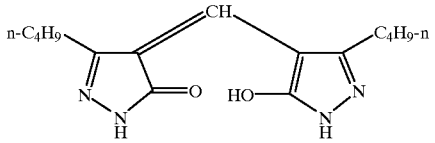

-continued
ExF-7
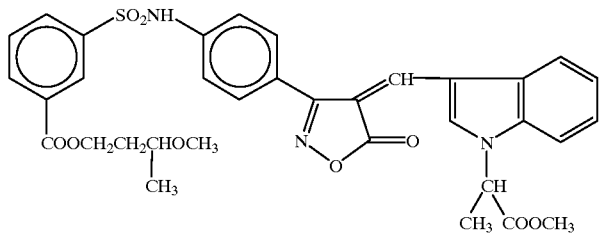
Cpd-1
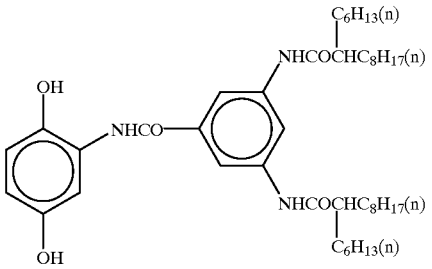
Cpd-2
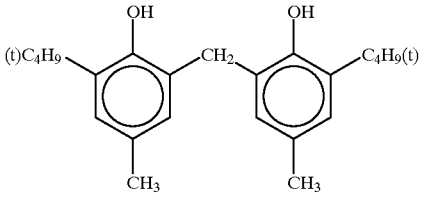
Cpd-3
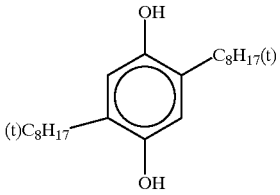
UV-1
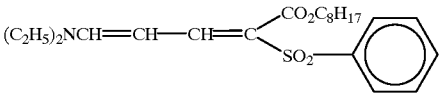
UV-2
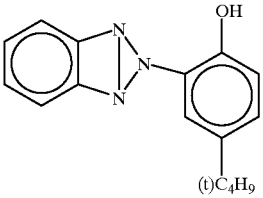
UV-3
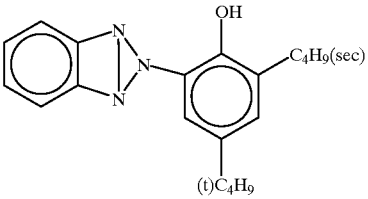

-continued
HBS-1
Tricresyl phosphate
HBS-2
Di-n-butyl phthalate
HBS-3
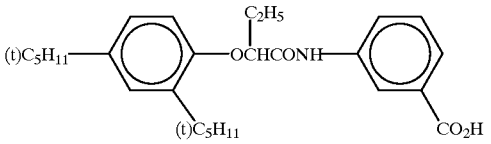
HBS-4
Tri(2-ethylhexyl) phosphate
ExS-1
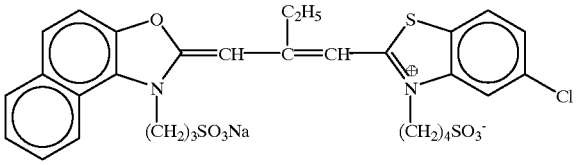
ExS-2
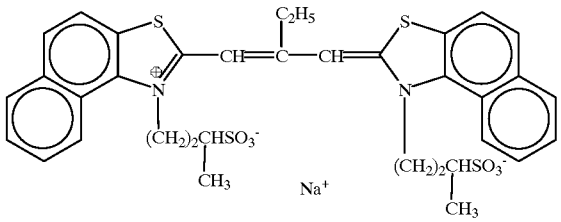
ExS-3
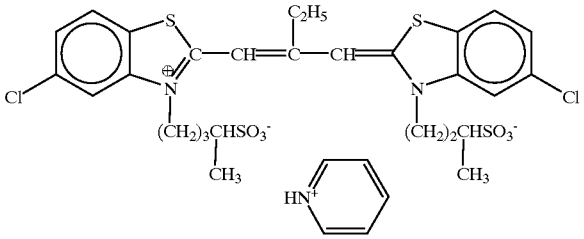
ExS-4
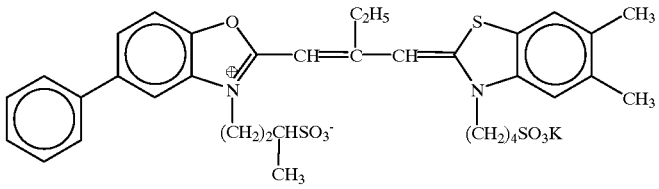
ExS-5
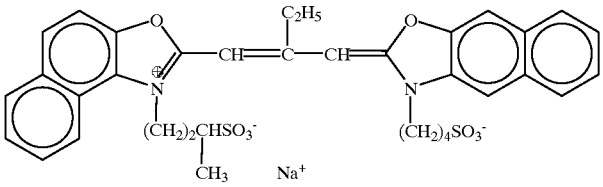

-continued
ExS-6
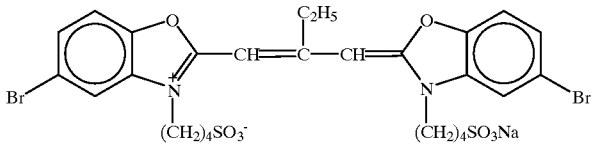
ExS-7
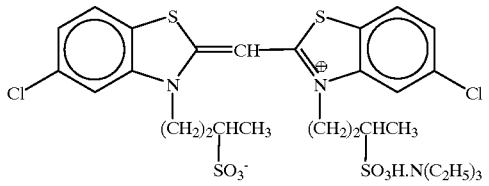
S-1
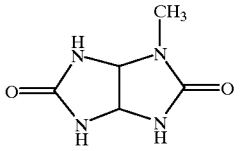
H-1
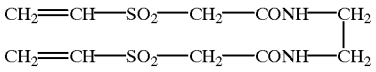
B-1
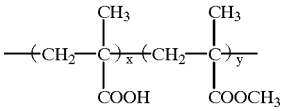
x/y=10/90(weight ratio)
average molecular
weight: ca. 35,000
B-2
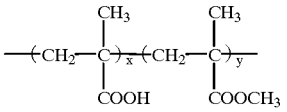
x/y=40/60(weight ratio)
average molecular
weight: ca. 20,000
B-3
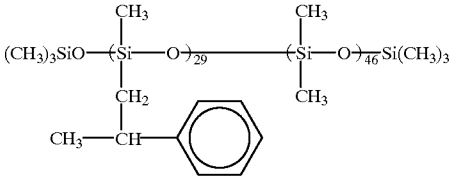
(molar ratio)
average molecular
weight: ca. 8,000
B-4
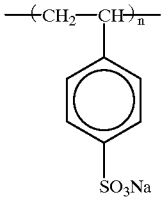
average molecular
weight: ca. 750,000
B-5
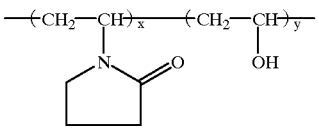
x/y=70/30(weight ratio)
average molecular
weight: ca. 17,000

-continued
B-6
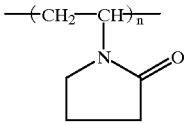
average molecular weight: ca. 10,000
W-1
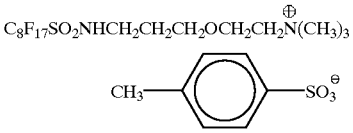
W-2
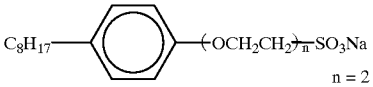
n = 2 ~ 4
W-3
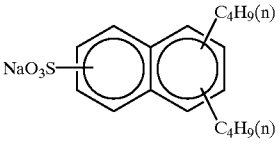
F-1
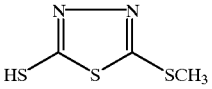
F-2
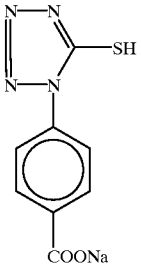
F-3
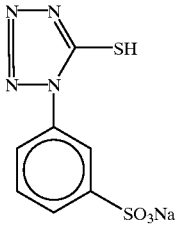
F-4
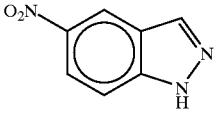
F-5
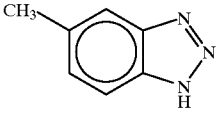

-continued
F-6
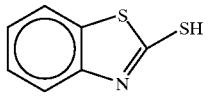
F-7
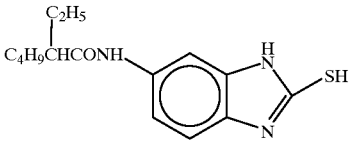
F-8
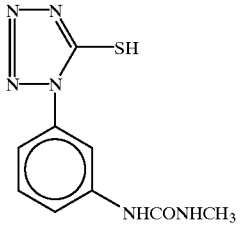
F-9
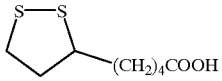
F-10
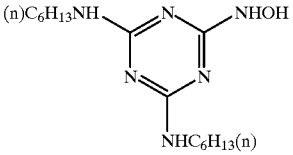
F-11
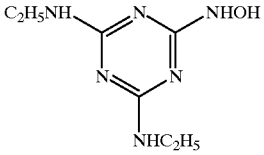
F-12
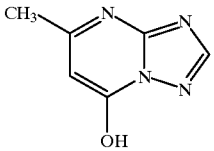
F-13
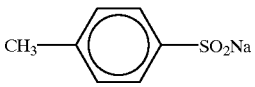
F-14
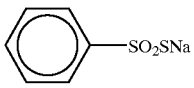

-continued

F-15

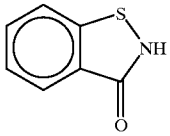

F-16

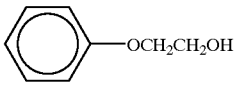

F-17

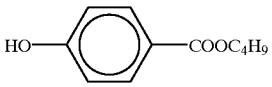

Samples that had been prepared by using dyes in the fifth layer, dyes in the ninth layer, and dyes in the twelfth layer, shown in Table 6 by means of Emulsion Nos., and by using (XX-16) or p-quinone, were subjected to exposure to light and development processing in the same manner as in Example 1, except that the SC39 filter and the SC50 filter were omitted. The sensitivity of each Sample is represented by a relative value of a reciprocity of an exposure amount at which an optical density of fog+0.1 was obtained.

The results are shown in Table 6.

TABLE 6

| Sample No. | Fifth Layer[1]) | Ninth Layer[1]) | Twelfth Layer[1]) | Oxidizing agent | Cyan Fog | Cyan Sensitivity | Magenta Fog | Magenta Sensitivity | Yellow Fog | Yellow Sensitivity | Remarks |
|---|---|---|---|---|---|---|---|---|---|---|---|
| 2001 | 120 | 113 | 101 | XX-16 | 0.26 | 100 (standard) | 0.36 | 100 (standard) | 0.19 | 100 (standard) | Comparative example |
| 2002 | 121 | 114 | 103 | XX-16 | 0.11 | 138 | 0.13 | 147 | 0.09 | 136 | This invention |
| 2003 | 120 | 113 | 101 | p-quinone | 0.26 | 98 | 0.36 | 98 | 0.19 | 90 | Comparative example |
| 2004 | 121 | 114 | 103 | p-quinone | 0.12 | 130 | 0.15 | 141 | 0.09 | 129 | This invention |

Note: [1])Used dyes in each layer were those for the numbered Emulsion shown in these columns and employed in Example 1.

As is apparent from the results shown in Table 6, it was also found, for multilayer color films, that the samples in which dyes in Emulsions 121, 114, and 103 for use in the present invention were employed, provided remarkably higher sensitivity and considerably lower fog, than did the samples in which dyes in Emulsions 120, 113, and 101, for comparison, were employed.

Further, it was found that thiosulfonic acid (XX-16) was more preferable than p-quinone as an oxidizing agent used at the time of production of a reduction-sensitized emulsion.

Example 3

1) Support

The support that was used in the present example was prepared as follows:

100 weight parts of polyethylene-2,6-naphthalate polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and stretched to 3.3-fold in the lengthwise direction at 140° C., and then to 3.3-fold in the width direction at 130° C.; and further they were thermally fixed for 6 seconds at 250° C., and a PEN film having a thickness of 90 $\mu$m was obtained. To the PEN film, appropriate amounts of a blue dye, a magenta dye, and a yellow dye (I-1, I-4, I-6, I-24, I-26, I-27, II-5, as described in Kokai Giho: Kogi No. 94-6023) were added. Further, this film was wound around a stainless steel core (spool) having a diameter of 20 cm, and thermal history was imparted thereto at 110° C. for 48 hours, to obtain a support having suppressed core-set-curl.

2) Coating of a subbing layer

A subbing layer having the composition mentioned below was coated on each side of the above support, after both surfaces of the support were subjected to corona discharge, UV discharge, and glow discharge treatments (10 ml/m$^2$, a bar coater was used). The subbing layer was provided on the side that was heated at a higher temperature at the time of stretching. Drying was carried out at 115° C. for 6 minutes (the roller and the transportation apparatus in the drying zone all were set at 115° C.).

Composition of Coating Solution for the Subbing Layer:

| | |
|---|---|
| Gelatin | 0.1 g/m$^2$ |
| Sodium $\alpha$-sulfo-di-2-ethylhexylsuccinate | 0.01 g/m$^2$ |
| Salicylic acid | 0.04 g/m$^2$ |
| p-Chlorophenol | 0.2 g/m$^2$ |
| $(CH_2{=}CHSO_2CH_2CH_2NHCO)_2CH_2$ | 0.012 g/m$^2$ |
| Polyamide-epichlorohydrin polycondensation product | 0.02 g/m$^2$ |

3) Coating of a backing layer

An antistatic layer, a magnetic recording layer, and a lubricant layer, each having the compositions mentioned below, were coated on one side of the above support coated with the subbing layer, as a backing layer.

3-1) Coating of an antistatic layer

A layer having the following composition was coated:

| | |
|---|---|
| A dispersion of fine grain powder of a composite of stannic oxide-antimony oxide having an average grain size of 0.005 μm, and the specific resistance of 5 Ω · cm (secondary aggregation grain size about 0.08 μm) | 0.2 g/m$^2$ |
| Gelatin | 0.05 g/m$^2$ |
| $(CH_2{=}CHSO_2CH_2CH_2NHCO)_2CH_2$ | 0.02 g/m$^2$ |
| Polyoxyethylene-p-nonylphenol (polymerization degree: 10) | 0.005 g/m$^2$ |
| Resorsine | |

3-2) Coating of a magnetic recording layer

3-Poly(polymerization degree: 15)oxyethylenepropyloxytrimethoxysilan (15 weight %)-coated Co—γ—$Fe_2O_3$ (specific surface area, 43 m$^2$/g; major axis, 0.14 μm; minor axis, 0.03 μm; saturation magnetization, 89 emu/g, $Fe^{2+}/Fe^{3+}$=6/94; the surface was treated with 2 wt % respectively, based on $Fe_2O_3$, of aluminum oxide and silicon oxide; a dispersion of the iron oxide was carried out by an open kneader and a sand mill) (0.06 g/m$^2$), diacetylcellulose (1.2 g/m$^2$), and the hardener $C_2H_5C(CH_2OCONH\text{-}C_6H_3(CH_3)NCO)_3$ (0.3 g/m$^2$) were coated using acetone, methylethylketone, and cyclohexanone, as solvents, by means of a bar coater, to obtain a magnetic recording layer having a film thickness of 1.2 μm. Silica grains (0.3 μm), as a matting agent, and 3-poly(polymerization degree: 15) oxyethylenepropyloxytrimethoxysilan (15 weight %)-coated aluminum oxide (0.15 μm), as an abrasive, were each added thereto, to give a coverage of 10 mg/m$^2$, respectively. Drying was conducted at 115° C. for 6 min (the roller and the transportation apparatus in the drying zone all were set at 115° C.). The increment of the color density of $D^B$ of the magnetic recording layer was about 0.1 when X-light (blue filter) was used. The saturation magnetization moment of the magnetic recording layer was 4.2 emu/g, the coercive force was $7.3\times10^4$ A/m, and the squareness ratio was 65%. Further, Samples having no magnetic recording layer were prepared for comparison.

3-3) Preparation of a lubricant layer

A lubricant layer was prepared by coating the following composition so that the solid part of the coating amount became the following amount, and the layer was dried at 115° C. for 6 minutes, to prepare a lubricant layer (the roller and the transportation apparatus in the drying zone all were set at 115° C.).

| | |
|---|---|
| Diacetyl Cellulose | 25 mg/m$^2$ |
| $C_6H_{13}CH(OH)C_{10}H_{20}COOC_{40}H_{81}$ (Compound a)* | 6 mg/m$^2$ |
| $C_{50}H_{101}O(CH_2CH_2O)_{16}H$ (Compound b) | 9 mg/m$^2$ |

*A mixture

The mixture of Compound a/Compound b (6/9) was dissolved in a solution of xylene and propyleneglycol monomethylether (1/1) at 105° C., and this solution was poured into a 10-fold volume of propyleneglycol monomethylether and finely dispersed. This was further dispersed in acetone, and the obtained dispersion (average grain diameter: 0.01 μm) was added to the coating solution. Silica grains (0.3 μm), as a matting agent, and 3-poly(polymerization degree, 15) oxyethylene-propyloxytrimethoxysilan (15 weight %)-coated aluminum oxide (0.15 μm), as an abrasive, were each added thereto, to give a coverage of 15 mg/m$^2$, respectively. The lubricant layer showed excellent performances of the coefficient of dynamic friction: 0.06 (a stainless steel hard ball of 5 mmϕ, diameter, load: 100 g, speed: 6 cm/min), and of the static friction coefficient: 0.07 (clip method). The sliding property of the lubricant layer with the surface of the emulsion, which will be described below, was also excellent, such that the coefficient of dynamic friction was 0.12.

4) Coating of light-sensitive layers

All layers, each of which had the same composition as in Example 2, were multi-coated on the opposite side of the backing layer as described above, and thereby samples 3001 to 3004 shown in Table 7 were prepared.

The thus-prepared light-sensitive materials were cut into films of 24 mm width and 160 cm length. Then, two perforations of 2 mm square were made at intervals of 5.8 mm in the length direction and were located at the position of 0.7 mm in the width direction from one side in the lengthwise direction of the light-sensitive material, respectively. Further, sets of such two perforations were made at 32 mm intervals. Each of the samples was encased in a plastic film cartridge, as illustrated in FIG. 1 to FIG. 7 of U.S. Pat. No. 5,296,887.

These samples 3001 to 3004 were exposed to light in the same manner as in Example 2, and then they were processed by the running processing described below, to evaluate their photographic properties in the same manner as in Example 2.

Each of the processing steps was performed using an autoprocessor FP-360B (manufactured by Fuji Photo Film Co., Ltd.), with the proviso that the autoprocessor was remodeled so that an overflow solution from the bleaching bath would not be flowed to the next bath, but would be discharged to a waste tank. Further, the autoprocessor FP-360B has a means for correcting evaporation, as described in *Kokai-giho* No. 94-4992 (Hatsumei-Kyokai).

The processing steps and the compositions of solutions are shown below.

| Processing step | Processing time | Processing temperature | Replenisher* | Tank Volume |
|---|---|---|---|---|
| Color developing | 3 min 5 sec | 37.8° C. | 20 ml | 11.5 liter |
| Bleaching | 50 sec | 38.0° C. | 5 ml | 5 liter |
| Fixing (1) | 50 sec | 38.0° C. | — | 5 liter |
| Fixing (2) | 50 sec | 38.0° C. | 8 ml | 5 liter |
| Washing | 30 sec | 38.0° C. | 17 ml | 3 liter |
| Stabilizing (1) | 20 sec | 38.0° C. | — | 3 liter |
| Stabiizing (2) | 20 sec | 38.0° C. | 15 ml | 3 liter |
| Drying | 1 min 30 sec | 60° C. | | |

Note:
*Replenishing amount per 1.1 m of the light-sensitive material having 35-mm width (equivalent to one 24 Ex.)

Stabilizings and fixings were carried out in a countercurrent mode from tank (2) to tank (1). Overflow solution from washing was all introduced into fixing bath (2). Further, the carried over amount of color developer to the bleaching step, the carried over amount of bleaching solution to the fixing step, and the carried over amount of fixing solution to the washing step were respectively 2.5 ml, 2.0 ml, and 2.0 ml, per 1.1 m of the light-sensitive material of a 35 mm width. Each crossover time was 6 sec and is included in the processing time of the preceding step.

Each opening area in the processor were 100 cm$^2$ for the color-developer, 120 cm$^2$ for the bleaching solution, and about 100 cm$^2$ for other processing solutions, respectively.

The composition of each processing solution was as follows, respectively:

| | Tank Solution (g) | Reple-nisher (g) |
|---|---|---|
| (Color-developer) | | |
| Diethylenetriaminepentaacetic acid | 3.0 | 3.0 |
| Disodium catecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)-amino]aniline sulfate | 4.5 | 6.5 |
| Water to make | 1.0 liter | 1.0 liter |
| pH | 10.05 | 10.18 |
| (pH was adjusted by potassium hydroxide and sulfuric acid) | | |
| (Bleaching solution) | | |
| 1,3-Diaminopropanetetraacetate Fe (III) ammonium monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 liter | 1.0 liter |
| pH | 4.6 | 4.0 |
| (pH was adjusted by aqueous ammonia) | | |

(Fixing tank (1) solution)

5:95 (volume ratio) mixture of the above bleaching tank solution and the fixing tank solution described below (pH 6.8).

(Fixing tank (2) solution)

| | Tank solution (g) | Reple-nisher (g) |
|---|---|---|
| Aqueous ammonium thiosulfate solution (750 g/liter) | 240 ml | 720 ml |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 liter | 1.0 liter |
| pH | 7.4 | 7.45 |

-continued (Fixing tank (2) solution)

| | Tank solution (g) | Reple-nisher (g) |
|---|---|---|
| (pH was adjusted by aqueous ammonia and acetic acid) | | |

(Washing water)

Tap water was treated by passage through a mixed bed ion-exchange column filled with H-type strong acidic cation exchange resin (Amberlite IR-120B, trade name, made by Rohm & Haas) and OH-type strong basic anion exchange resin (Amberlite IR-400, the same as the above) so that the concentrations of Ca ions and Mg ions in water were both made to decrease to 3 mg/liter or below, followed by adding 20 mg/liter of sodium dichlorinated isocyanurate and 150 mg/liter of sodium sulfate. The pH of this water was in the range of 6.5 to 7.5.

(Stabilizing solution)

| (Both tank solution and replenisher) | (g) |
|---|---|
| Sodium p-toluene sulfinate | 0.03 |
| Polyoxyethylene-p-monononylphenylether (av. polymerization degree: 10) | 0.2 |
| Sodium 1,2-benzoylthiazoline-3-one | 0.10 |
| Disodium ethylenediaminetetraacetate | 0.05 |
| 1,2,4-Triazole | 1.3 |
| 1,4-Bis(1,2,4-triazole-1-ylmethyl)piperazine | 0.75 |
| Water to make | 1.0 liter |
| pH | 8.5 |

The results of evaluation are shown in Table 7. As is apparent from the results in Table 7, Samples 3002 and 3004 of the present invention exhibited remarkably higher sensitivity and considerably lower fog, compared to Samples 3001 and 3003 of comparative examples.

Further, by the comparison between the presence and the absence of a magnetic recording layer, both an increase of fog and a reduction of sensitivity due to the magnetic recording layer were observed with respect to the comparative samples. In contrast, with respect to the samples in which dyes for use in the present invention were used, photographic properties were not affected by the presence of a magnetic recording layer, and moreover neither an increase of fog nor a reduction of sensitivity was observed.

TABLE 7

| Sample | Sample No. of Emulsion | Magnetic recording | Cyan | | Magenta | | Yellow | | |
|---|---|---|---|---|---|---|---|---|---|
| No. | Layer | layer | Fog | Sensitivity | Fog | Sensitivity | Fog | Sensitivity | Remarks |
| 3001 | 2001 | presence | 0.27 | 100 (standard) | 0.38 | 100 (standard) | 0.20 | 100 (standard) | Comparative example |
| 3002 | 2002 | presence | 0.11 | 138 | 0.13 | 150 | 0.09 | 140 | This invention |
| 3003 | 2001 | none | 0.27 | 100 | 0.37 | 102 | 0.19 | 102 | Comparative example |
| 3004 | 2002 | none | 0.11 | 138 | 0.13 | 150 | 0.09 | 140 | This invention |

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material having at least one silver halide emulsion layer on a support, wherein the silver halide grains in at least one of the emulsion layers have been subjected to reduction sensitization, and at least one of the emulsion layers contains at least one compound represented by formula (I):

formula (I)

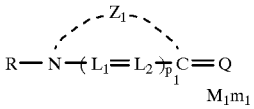

wherein R represents a sulfoalalkenyl group; $L_1$ and $L_2$ each represent a methine group; $p_1$ represents 0 or 1; $Z_1$ represents a group of atoms required to form a 5- or 6-membered nitrogen-containing heterocycle; $M_1$ represents a counter ion for balance of a charge; $m_1$ represents a number of from 0 to 10 required to neutralize a charge of the molecule; and Q represents a methine group or a polymethine group, each of which is substituted with a heterocyclic group or an aromatic group.

2. The silver halide photographic light-sensitive material as claimed in claim 1, wherein the compound represented by formula (I) is a compound represented by formula (II):

formula (II)

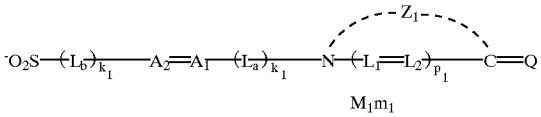

wherein $L_a$ and $L_b$ each represent a methylene group; $A_1$ and $A_2$ each represent a methine group; $k_1$ and $k_2$ each represent an integer of from 0 to 10; and $L_1$, $L_2$, $p_1$, $Z_1$, $M_1$, $m_1$, and Q each have the same meanings as those defined in general formula (I).

3. The silver halide photographic light-sensitive material as claimed in claim 2, wherein the compound represented by formula (II) is a compound represented by formula (III), (IV), or (V):

formula (III)

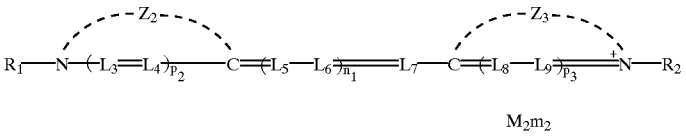

wherein $L_3$, $L_4$, $L_5$, $L_6$, $L_7$, $L_8$, and $L_9$ each represent a methine group; $P_2$ and $p_3$ each represent 0 or 1; $n_1$ represents 0, 1, 2, or 3; $Z_2$ and $Z_3$ each represent a group of atoms required to form a 5- or 6-membered nitrogen-containing heterocycle; $M_2$ represents a counter ion for balance of a charge; $m_2$ represents a number of from 0 to 4 required to neutralize a charge of the molecule; and $R_1$ and $R_2$ each represent an alkyl group, with the proviso that at least one of $R_1$ and $R_2$ is an alkyl group represented by $R_z$:

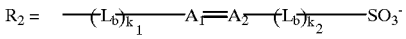

wherein $L_a$, $L_b$, $A_1$, $A_2$, $k_1$ and $k_2$ each have the same meanings as those defined in general formula (II), formula (IV)

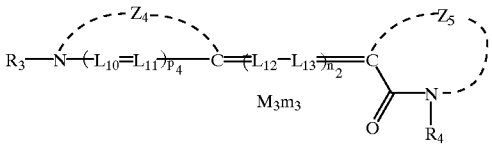

wherein $L_{10}$, $L_{11}$, $L_{12}$, and $L_{13}$ each represent a methine group; $p_4$ represents 0 or 1; $n_2$ represents 0, 1, 2, or 3; $Z_4$ and $Z_5$ each represent a group of atoms required to form a 5- or 6-membered nitrogen-containing heterocycle; $M_3$ represents a counter ion for balance of a charge; $m_3$ represents a number of from 0 to 4 required to neutralize a charge of the molecule; $R_3$ represents an alkyl group, and $R_4$ represents an alkyl group, an aryl group, or a heterocyclic group, with the proviso that $R_3$ is the alkyl group represented by $R_z$, formula (V)

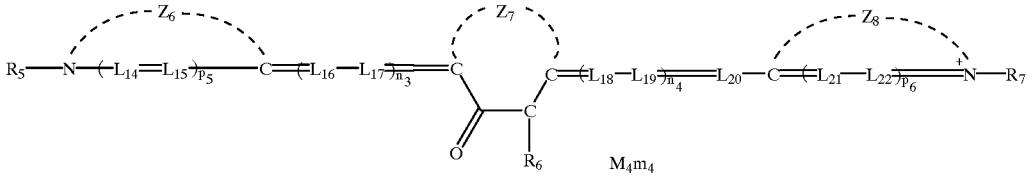

wherein $L_{14}$, $L_{15}$, $L_{16}$, $L_{17}$, $L_{18}$, $L_{19}$, $L_{20}$, $L_{21}$, and $L_{22}$ each represent a methine group; $p_5$ and $p_6$ each represent 0 or 1; $n_3$ and $n_4$ each represent 0, 1, 2, or 3; $Z_6$, $Z_7$, and $Z_8$ each represent a group of atoms required to form a 5- or 6-membered nitrogen-containing heterocycle; $M_4$ represents a counter ion for balance of a charge; $m_4$ represents a number of from 0 to 4 required to neutralize a charge of the molecule; $R_5$ and $R_7$ each represent an alkyl group, and $R_6$ represents an alkyl group, an aryl group, or a heterocyclic group, with the proviso that at least one of $R_5$ and $R_7$ is the alkyl group represented by $R_z$.

4. The silver halide photographic light-sensitive material as claimed in claim 3, wherein the compound represented by general formula (II) is the compound represented by general formula (III).

5. The silver halide photographic light-sensitive material as claimed in claim 1, wherein the sulfoalkenyl group represented by R in formula (I) is selected from the group consisting of $Ra_1$, $Ra_2$, $Ra_3$, $Ra_4$, $Ra_5$, $Ra_6$, $Ra_7$, $Ra_8$ and $Ra_9$,

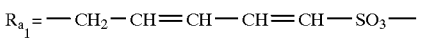

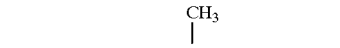

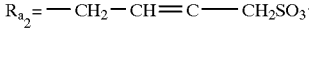

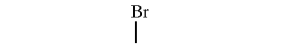

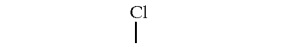

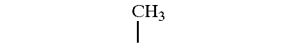

-continued

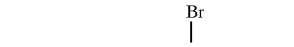

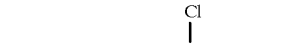

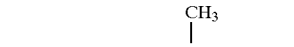

6. The silver halide photographic light-sensitive material as claimed in claim 5, wherein the sulfoalalkenyl group represented by R in formula (I) is $Ra_9$.

7. The silver halide photographic light-sensitive material as claimed in claim 1, wherein the amount of the compound represented by formula (I) to be added is in the range of from $0.5\times10^{-6}$ mol to $1.0\times10^{-2}$ mol, per mol of silver halide.

8. The silver halide photographic light-sensitive material as claimed in claim 1, further containing at least one compound represented by formula (XX), (XXI), or (XXII):

formula (XX) $R_{101}$—$SO_2S$—$M_{101}$ formula (XXI) $R_{101}$—$SO_2S$—$R_{102}$ formula (XXII) $R_{101}$—$SO_2S$—$(E)_a$—$SSO_2$—$R_{103}$ wherein $R_{101}$, $R_{102}$, and $R_{103}$ each represent an aliphatic group, an aromatic group, or a heterocyclic group; $M_{101}$ represents a cation, E represents a divalent linking group, and a is 0 or 1.

9. The silver halide photographic light-sensitive material as claimed in claim 1, further containing at least one compound represented by formula (XX)

$$R_{101}—SO_2S—M_{101}$$

wherein $R_{101}$ represents an aliphatic group, an aromatic group, or a heterocyclic group; and $M_{101}$ represents a cation.

10. The silver halide photographic light-sensitive material as claimed in claim 8, wherein the addition amount of the compound represented by formula (XX), (XXI), or (XXII) is from $10^{-7}$ mol to $10^{-1}$ mol, per mol of silver halide.

11. The silver halide photographic light-sensitive material as claimed in claim 1, comprising a transparent magnetic recording layer.

* * * * *